US012442608B2

(12) United States Patent
Kras et al.

(10) Patent No.: US 12,442,608 B2
(45) Date of Patent: Oct. 14, 2025

(54) MACHINE GUN TRIGGER WITH SELECT FIRE

(71) Applicant: Sig Sauer, Inc., Newington, NH (US)

(72) Inventors: Krzysztof J. Kras, Fremont, NH (US); Brian J. Barnhart, Newmarket, NH (US); Adrian Thomele, Stratham, NH (US)

(73) Assignee: Sig Sauer, Inc., Newington, NH (US)

( * ) Notice: Subject to any disclaimer, the term of this patent is extended or adjusted under 35 U.S.C. 154(b) by 326 days.

(21) Appl. No.: 18/315,726

(22) Filed: May 11, 2023

(65) Prior Publication Data

US 2024/0102761 A1 Mar. 28, 2024

Related U.S. Application Data

(60) Provisional application No. 63/342,270, filed on May 16, 2022.

(51) Int. Cl.

| | |
|---|---|
| ***F41A 17/56*** | (2006.01) |
| ***F41A 19/32*** | (2006.01) |
| ***F41A 19/33*** | (2006.01) |
| ***F41A 19/45*** | (2006.01) |

(52) U.S. Cl.

CPC ..... *F41A 19/45* (2013.01); *F41A 17/56* (2013.01); *F41A 19/32* (2013.01); *F41A 19/33* (2013.01)

(58) Field of Classification Search

CPC ..... F41A 19/25; F41A 19/27; F41A 19/29; F41A 19/30; F41A 19/31; F41A 19/32; F41A 19/33

See application file for complete search history.

(56) References Cited

U.S. PATENT DOCUMENTS

| | | | | | |
|---|---|---|---|---|---|
| 1,437,889 | A | * | 12/1922 | Eickhoff | F41A 19/33 89/142 |
| 2,356,726 | A | * | 8/1944 | Reising | F41A 19/30 89/184 |
| 2,356,727 | A | * | 8/1944 | Reising | F41A 19/33 89/142 |
| 2,377,737 | A | * | 6/1945 | Williams | F41A 19/30 89/145 |
| 2,422,854 | A | * | 6/1947 | Reising | F41A 19/31 89/154 |

(Continued)

FOREIGN PATENT DOCUMENTS

IT GE20090033 A1 * 11/2010

*Primary Examiner* — Gabriel J. Klein
(74) *Attorney, Agent, or Firm* — Finch & Maloney PLLC

(57) ABSTRACT

A trigger assembly includes a selector operable between a safe position, a semiautomatic fire position, and an automatic fire position. In one example, the assembly includes a trigger rotatable between a resting position and a pulled position, a disconnector pivotable between a first position where it is in the path of the operational rod, and a second position where it is out of the path of the operational rod. A sear is pivotable between an engaged position and a disengaged position and is biased to the engaged position where it is positioned in the path of the operational rod. A sear link is pivotably connected to the trigger, such that pulling the trigger moves the sear link into contact with the sear to pivot the sear towards the disengaged position. The sear link is spaced from the sear when the trigger is in the resting position.

24 Claims, 29 Drawing Sheets

(56) References Cited

U.S. PATENT DOCUMENTS

| | | | | | |
|---|---|---|---|---|---|
| 3,196,747 | A * | 7/1965 | Gallagher | F41A 19/31 | 42/69.02 |
| 3,246,566 | A * | 4/1966 | Ordner, Jr. | F41A 19/32 | 89/144 |
| 3,618,455 | A * | 11/1971 | Plumer | F41A 17/16 | 89/142 |
| 3,695,143 | A * | 10/1972 | Frix | F41A 19/32 | 89/145 |
| 4,505,182 | A * | 3/1985 | Sullivan | F41A 17/16 | 42/69.02 |
| 4,697,495 | A * | 10/1987 | Beretta | F41A 19/33 | 89/142 |
| 7,676,974 | B2 * | 3/2010 | Zemanek | F41A 3/40 | 89/149 |
| 8,087,343 | B2 * | 1/2012 | Landies | F41A 19/31 | 89/139 |
| 8,453,554 | B2 * | 6/2013 | Landies | F41A 19/02 | 89/128 |
| 8,459,172 | B2 * | 6/2013 | Landies | F41A 19/01 | 89/128 |
| 9,222,746 | B2 * | 12/2015 | Doll | F41A 17/46 | |
| 9,683,800 | B2 * | 6/2017 | Sewell, Jr. | F41A 19/45 | |
| 10,288,373 | B1 * | 5/2019 | Hardman | F41A 19/12 | |
| 2012/0144992 | A1 * | 6/2012 | Landies | F41A 9/10 | 89/128 |
| 2020/0363153 | A1 * | 11/2020 | Franssen | F41A 17/58 | |
| 2021/0041198 | A1 * | 2/2021 | Franssen | F41A 19/46 | |
| 2024/0102761 | A1 * | 3/2024 | Kras | F41A 17/46 | |

* cited by examiner

MACHINE GUN TRIGGER WITH SELECT FIRE

RELATED APPLICATIONS

This application claims the benefit under 35 U.S.C. § 119(e) of U.S. Provisional Patent Application No. 63/342,270 filed on May 16, 2022, the contents of which are incorporated herein by reference in its entirety.

TECHNICAL FIELD

The present disclosure generally relates to fire control assemblies for firearms and more specifically to a select fire trigger assembly for a machine gun.

BACKGROUND

A machine gun typically operates using an open-bolt system. When the gun is ready to shoot, the bolt is held open and a round of belted ammunition is on the feed tray. Pulling the trigger releases the bolt forward to strips the round from the belt and chamber the round. At the same time, the bolt locks closed and the firing pin contacts the ammunition primer to fire the weapon. Some machine guns use high pressure gases to actuate a gas piston to cycle the action, pushing the bolt rearward. Traditionally, the machine gun has no reason for single shot function, and therefore a machine gun does not have a selector for selecting between semiautomatic and fully automatic fire. One such rifle is the M240 machine gun chambered in 7.62×51 mm ammunition.

Other rifles operate using a closed-bolt system, where ammunition is provided to the gun from a detachable magazine installed in the magazine well. In a ready-to-fire condition, the bolt is locked closed in the forward position with a round in the chamber. Pulling the trigger releases a hammer that strikes the firing pin and drives it into the ammunition primer to fire the gun. High pressure gases directly or indirectly drive the bolt-carrier assembly rearward to extract the spent cartridge, followed by the bolt returning forward to strip a new round from the top of the magazine and chamber the round, again making the gun ready to fire. Such closed-bolt rifles commonly include a selector for selecting between safe, semiautomatic fire, and sometimes automatic fire. Examples of such a rifle include the AR-15 rifle chambered in 5.56×45 mm ammunition.

SUMMARY

One aspect of the present disclosure is directed to a select fire trigger assembly for a machine gun having an open-bolt operation. In one example, the trigger assembly includes a selector operable between safe, semiautomatic fire, and fully automatic fire positions. In some embodiments, the selector may include a burst fire position. In some embodiments, the selector permits charging the action while the selector is in the safe position. For example, in the safe position the sear can move due to impact from the bolt being drawn rearward, but the trigger is blocked from moving. For an additional layer of safety, the trigger assembly may include a sear block that prevents inadvertent firing when the firearm is dropped.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
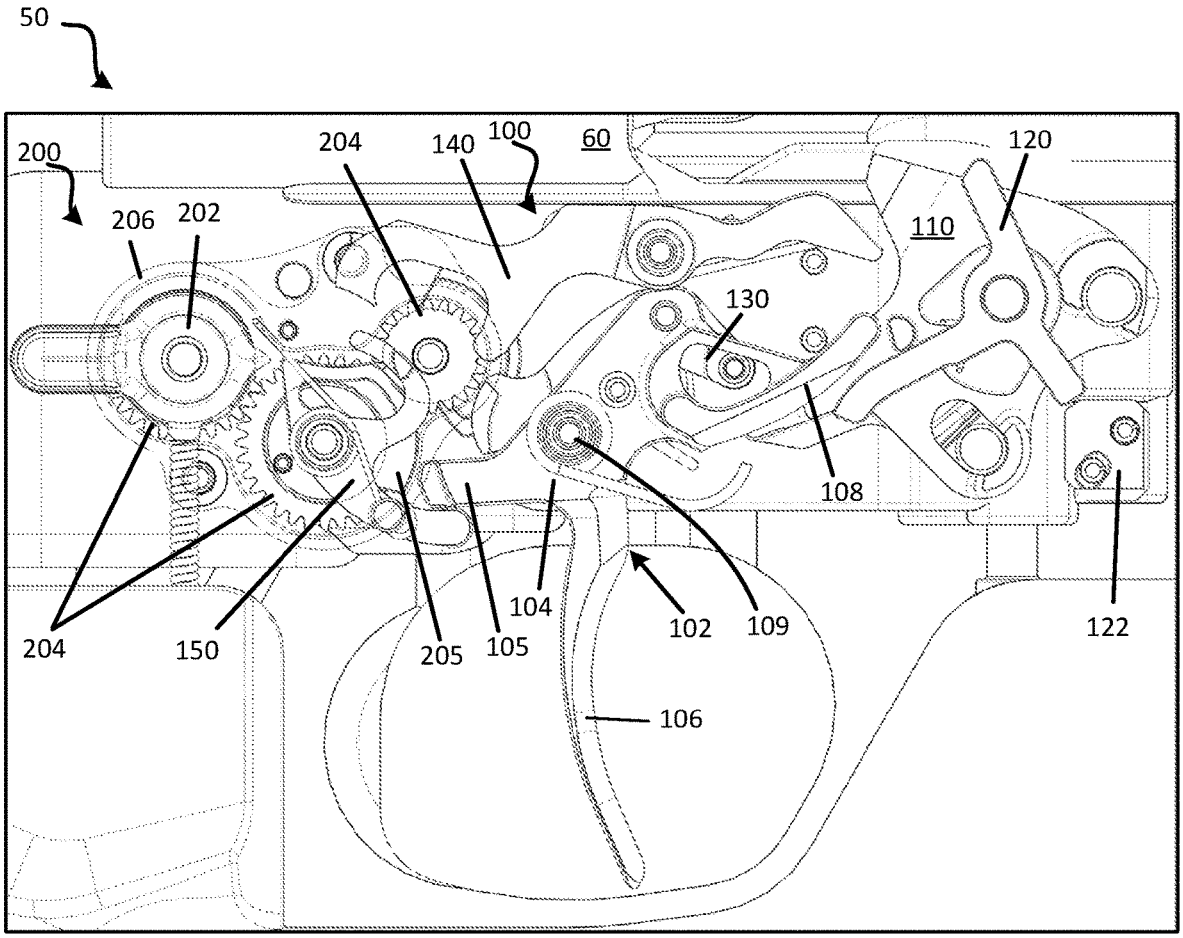
FIG. 1 is a right-side view showing part of a receiver of a machine gun and components of a trigger assembly, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a trigger assembly for a machine gun with an open-bolt system of operation. In accordance with some embodiments, the trigger assembly has a selector operable between safe, automatic fire, and semiautomatic fire positions. In one embodiment, the selector includes gears that operate to rotate cams or blocks to various positions when the selector is moved. For example, in the automatic fire position, a cam pivots the disconnector out of engagement with the operational rod and trigger, allowing automatic fire while the trigger is pulled. With the selector in the safe position, the trigger is blocked from movement, but the sear is moveable to allow charging the action. For semiautomatic fire, a disconnector and sear link allow the sear to resume engagement with the operational rod while the trigger remains in a pulled position.

In some embodiments, the assembly includes a sear block that prevents the sear from rotating and releasing the operational rod, such as due to an impulse. When the selector is in the safe position the sear block allows the sear to pivot downward during rearward movement of the operational rod so that the action can be charged. During use, pulling the trigger moves the sear block to a non-blocking position so that the sear can disengage from the operational rod when the trigger is pulled.

Embodiments of a machine gun according to the present disclosure may include one or more advantageous features that include an open-bolt operating system with a selector providing the user with the ability to select between safe, automatic fire, and semiautomatic fire; a selector operable with gears; a disconnector catch that reduces damage and wear on the disconnector caused by hard cycling of the operational rod and that prevents undesirable reconnecting of the sear link with the sear when the returning operational rod pushes the sear down; a rolling connection between the sear link and the sear; a sear block that prevents the sear from disengaging from the operational rod due to an impulse (e.g., a drop); a disconnector that ensures that the sear returns to the catch position during semiautomatic fire; and a safe selector position in which the trigger is prevented from being pulled by the trigger block operated by gears in the selector switch assembly. Numerous variations and embodiments will be apparent in light of the detailed disclosure.

Overview

Traditionally, machine guns do not have a select fire function. In some instances, however, it has been found that the operator may prefer semiautomatic fire to reduce ammunition consumption, for sighting the optics or fixed sights, or to avoid doubling or tripling a shot unnecessarily. For example, when the machine gun is used for taking a single, well-placed shot, the ability to do so using semiautomatic fire is desirable. In addition, recent military specifications for machine guns require a select fire on some open-bolt machine guns. Therefore, a need exists for a trigger assembly with select fire for a machine gun.

One attempt at a select fire mechanism for an M240 machine gun enables the operator to select between automatic and semiautomatic fire. The mechanism utilizes a selector on the outside of the receiver and has a shaft passing crosswise through the receiver. When the selector is in the semiautomatic fire position, a round surface of the shaft positions a disconnector to release from the sear after pulling the trigger so that the sear returns to its resting position where it engages the sear ledge on the operational rod after the operational rod returns rearward. When the selector instead is in the full-automatic position, a flat on the selector shaft allows the disconnector to remain engaged with the sear so long as the trigger is pulled, therefore allowing the sear to remain out of the path of the operational rod rather than resetting after each shot fired.

Despite existing selectors, non-trivial challenges remain. Accordingly, the present disclosure is directed to a selector for an open-bolt machine gun, where the selector can be operated between safe, semiautomatic fire, and fully automatic fire.

As discussed herein, terms referencing direction, such as upward, downward, vertical, horizontal, left, right, front, back, etc., are used for convenience to describe components of a rifle oriented in a traditional shooting position with the barrel extending horizontally in front of the user. Embodiments of the present disclosure are not limited by these directional references and it is contemplated that a firearm and its components in accordance with the present disclosure could be used in any orientation.

Example Embodiments

FIG. 1 is a side view showing part of a machine gun 50 with a trigger assembly 100, in accordance with an embodiment of the present disclosure. In FIG. 1, the trigger 102 is shown in a resting position and the selector 202 in a safe position. In this example, the trigger housing 60 of the machine gun 50 is shown as transparent to better illustrate components of the trigger assembly 100.

The trigger assembly 100 and includes a selector assembly 200 with a selector 202 on the outside of the housing so that it is operable by the user between a plurality of positions. In some embodiments, the selector 202 includes a safe position, an automatic fire position, and a semiautomatic fire position by rotating the selector 202 about its axis. In some embodiments, the selector assembly 200 includes two or more gears 204 that rotate in response to rotating the selector 202. The gears 204 can rotate to position one or more components of the trigger assembly 100, such as the disconnector 140 and the trigger block 205. In some embodiments, the gears 204 are in a gearbox 206.

The trigger assembly 100 also includes a trigger 102 having a trigger body 104, a trigger shoe 106 extending down from the trigger body 104, a trigger blade 105 extending rearward from the trigger body, and a forward arm 108 extending generally forward from the trigger body 104. The trigger body 104 includes the pivot axis and the center of gravity of the trigger 102, in accordance with some embodiments. The trigger 102 can pivot about a trigger pin 109 between a resting position and a pulled position. The trigger assembly 100 also includes a sear 110 pivotable between engaged and disengaged positions, a sear block 120, a sear link 130, a disconnector 140, and a disconnector catch 150. Components of the trigger assembly 100 are pivotable or rotatable about pins and may be biased to a particular position by a spring or springs. In some embodiments, the disconnector 140 may be referred to as a manual disconnector, and the sear link 130 may alternately be referred to as an auto disconnector or automatic disconnector. Operation of the selector assembly 200 and trigger assembly 100 is discussed below.

Figure 2:
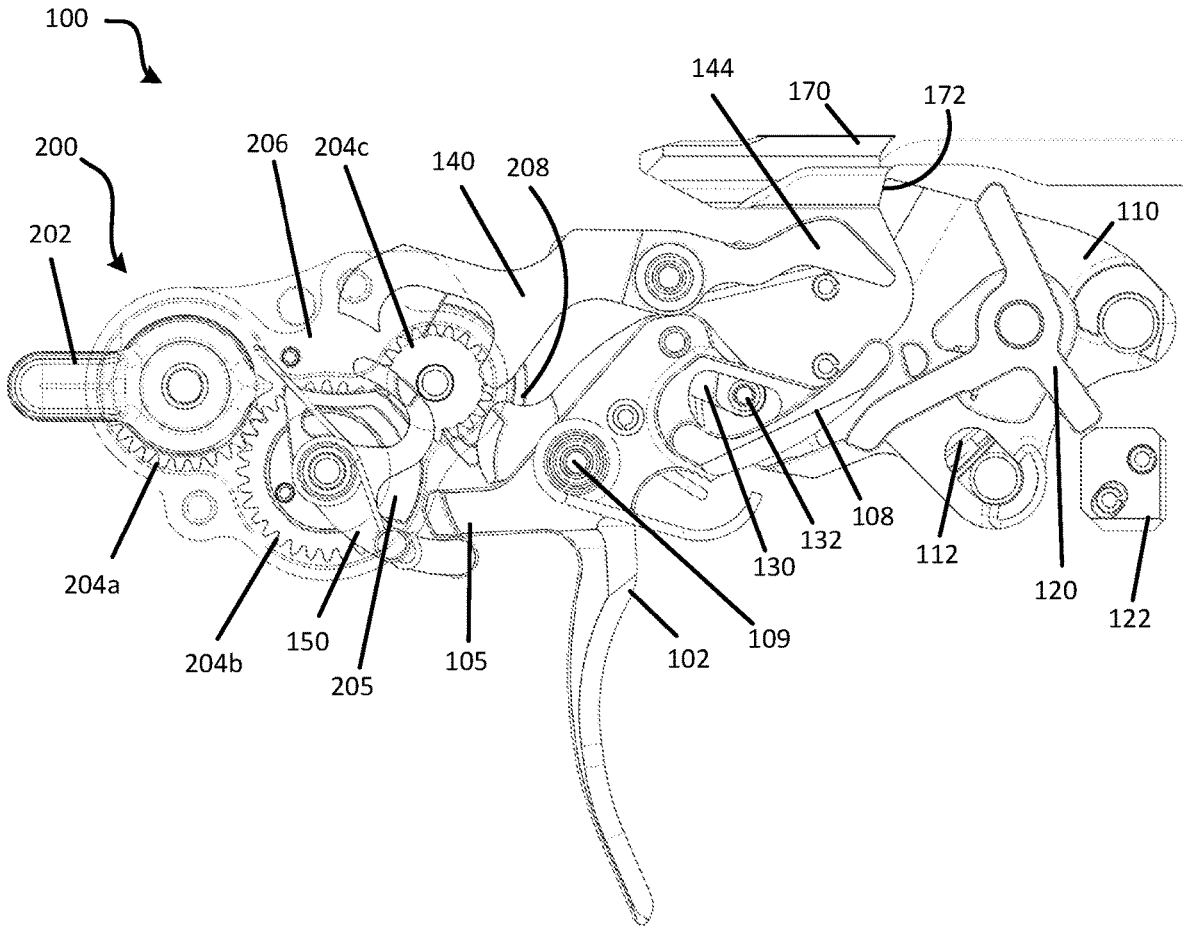
FIG. 2 is a side view showing components of the trigger assembly of FIG. 1 with the selector in the safe position and the operational rod held in the rearward position by engagement with the sear, in accordance with an embodiment of the present disclosure.

FIG. 2 is a side view showing components of the trigger assembly 100 of FIG. 1 with the selector 202 in the safe position and the operational rod 170 engaging the sear ledge 172 of the sear 110, in accordance with an embodiment of the present disclosure. The position shown in FIG. 2 may be referred to as a cocked and safe position. In this example, the sear block 120 is oriented in close proximity of a boss or block 122, thereby preventing the sear 110 from rotating out of engagement with the operational rod 170. The forward arm 108 of the trigger 102 is spaced from the sear block 120 and the roller 132 on the sear link 130 is spaced from contacting the sear 110. The larger radius of the cam 208 pivots the disconnector 140 so that the fore portion 144 is below the operational rod 170. A sear spring 112 biases the sear 110 towards the engaged position, as shown.

A selector assembly 200 includes a first gear **204*a* that is concentric with and operably coupled to the selector 202, a second gear 204*b* that is operationally connected to the first gear 204*a*, and a third gear 204*c* that is operationally connected to the second gear 204*b*. Rotating the selector 202 rotates the first gear 204*a*, which rotates the second gear 204*b*, which in turn rotates the third gear 204*c*. A trigger block 205 is concentric with the second gear 204*b* and rotates with the second gear 204*b*. A cam 208 is concentric with and rotates with the third gear 204*c*. When the selector 202 is in the safe position, the trigger block 205 is oriented to interfere with the trigger blade 105, thereby preventing the trigger 102 from being pulled. For example, in an attempt to pull the trigger 102, the end of the trigger blade 105 will contact the rounded surface of the trigger block 205. In the resting state, however, the trigger blade 105 is spaced sufficiently from the trigger block 205 so as to not inhibit operation of the selector 202**.

In some embodiments, the gearbox 206 can be filled with grease to reduce or eliminate intrusion of particles. In one such embodiment, the grease may combine with firing residue and/or other particles along an outside perimeter of the gearbox 206. This combination of grease and particles may harden, become sufficiently viscous, or otherwise function as a gasket to seal the gearbox 206 from moisture and particles and prevent intrusion of contaminants into the gears 204.

Figure 3:
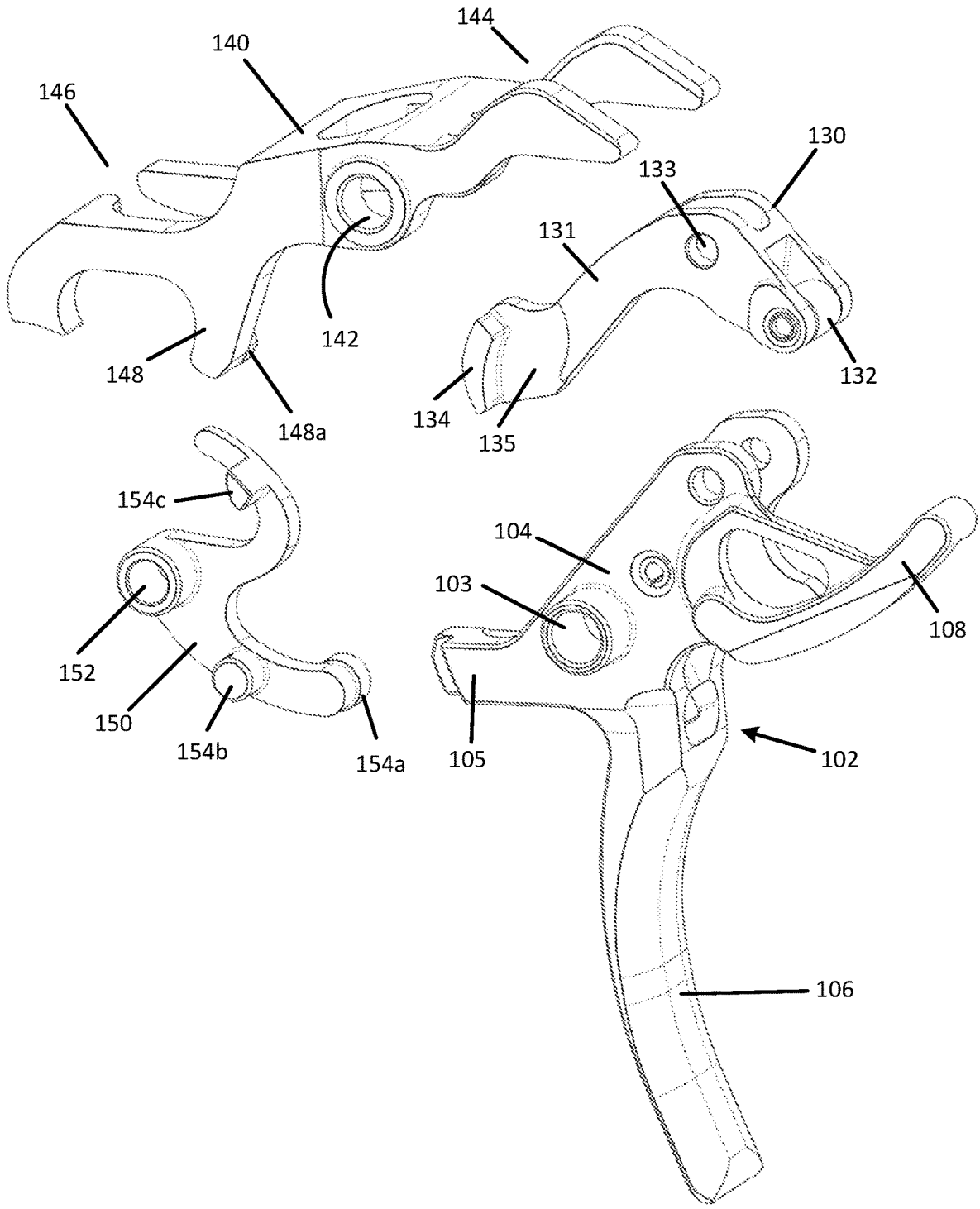
FIG. 3 is a front perspective view showing a trigger, sear link, disconnector, and disconnector catch of a trigger assembly, in accordance with some embodiments of the present disclosure.

FIG. 3 is a front perspective view showing a trigger 102, sear link 130, disconnector 140, and disconnector catch 150, in accordance with some embodiments of the present disclosure. The disconnector catch 150 is not required in all embodiments. As noted above, the trigger 102 includes a trigger shoe 106, trigger blade 105, forward arm 108, and trigger body 104. The trigger 102 pivots about a trigger pin that extends through a pin opening 103 in the trigger body 104. As shown, the forward arm 108 may extend upward and forward at an angle of 20-60 degrees, such as about 35 degrees. When assembled, the sear link 130 is pivotably connected to an upper portion of the trigger body 104. In this example, the sear link 130 generally has an inverted V shape with its pivot point 133 adjacent the apex of the V shape. In the resting position of the trigger 102, the body 131 of the sear link 130 mates with or abuts the trigger pin 109 (shown in FIG. 2). Pulling the trigger 102 rotates the sear link 130 towards the sear 110. In some embodiments, the sear link 130 includes a roller 132 on a forward end and a catch 134 on a rear end, so that the pivot point 133 is between the roller 132 and catch 134. The roller 132 reduces wear and friction during a trigger pull. The roller 132 can also reduce the trigger pull force. Adjacent the catch 134 the sear link 130 defines a pocket 135 to receive the boss 148*a* located on the end of the downward leg 148 of the disconnector 140.

In this example the disconnector catch 150 generally has a "Z" shape or "2" shape with an upper portion directed in a first direction (e.g., rearward) and a lower portion directed in an opposite second direction (e.g., forward). The disconnector catch 150 includes a plurality of bosses or catches 154 and defines a pin opening 152. A first boss 154*a* on the lower portion of the disconnector catch 150 is positioned to engage a bottom of the trigger blade 105, such as shown in FIG. 2. A second boss 154*b* can be used to engage a leg of a torsion spring. A third boss 154*c* on an upper portion may engage the disconnector 140 when the selector 202 is in the semiautomatic fire position. The disconnector catch 150 prevents the sear link 130 from reconnecting with the sear 110 in semiautomatic fire. The disconnector catch 150 also reduces wear on the disconnector 140 by reducing impact between the operational rod 170 and the disconnector 140 as the operational rod 170 returns rearward in semiautomatic fire.

The disconnector 140 defines and pivots about a pin opening 142 between a fore portion 144 and an aft portion 146. In this example, the fore portion 144 is forked and includes a rounded top surface for engagement with the operational rod 170. For example, as the operational rod 170 moves forward or rearward, the operational rod 170 may contact the sloped portion of the fore portion 144 to deflect the fore portion 144 downwards. The aft portion 146 is also forked in this example and includes catch surfaces and a downward leg 148 that may engage the sear link 130 when the selector 202 is in the semiautomatic fire position and/or in the automatic position.

Figure 4:
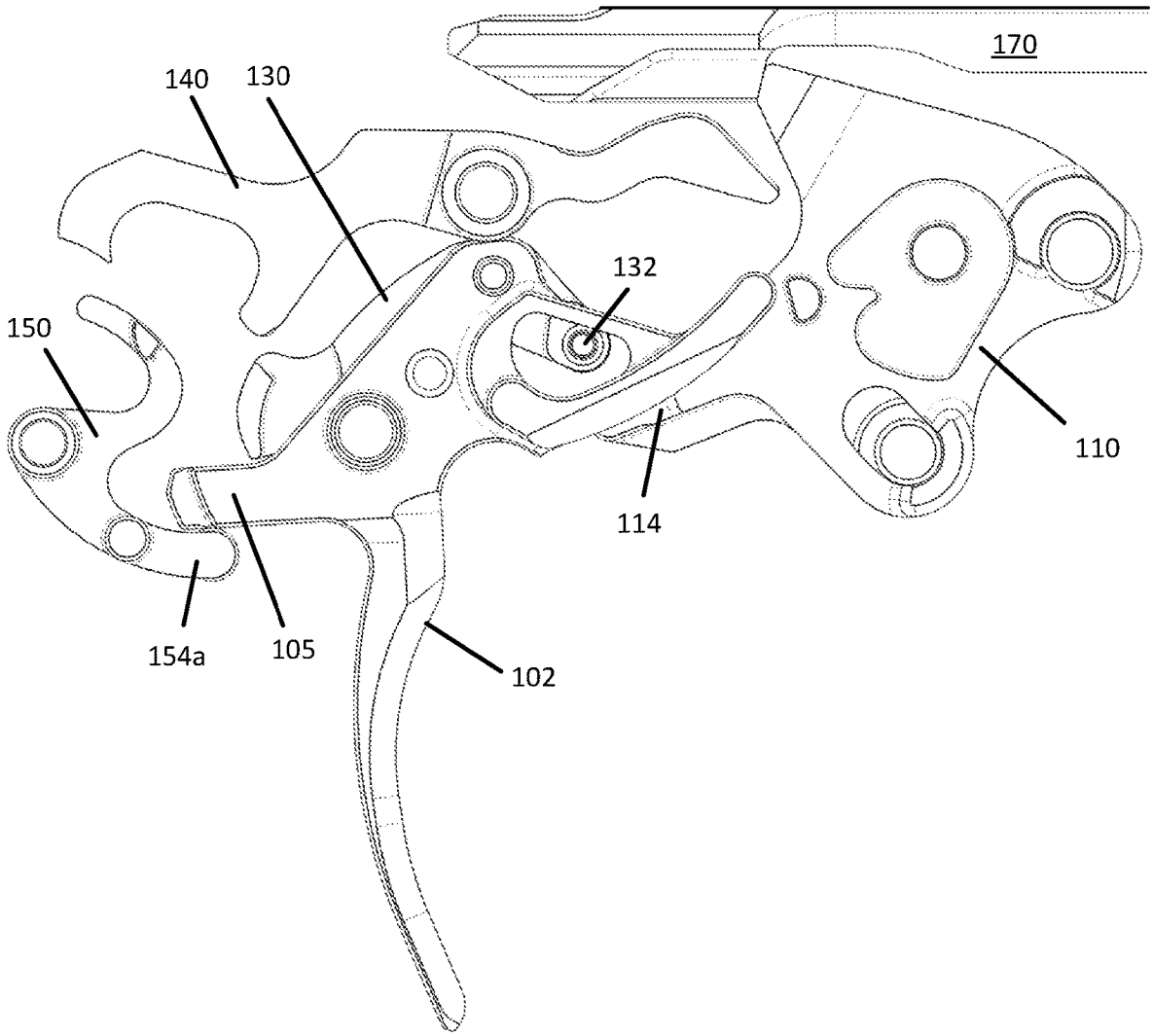
FIG. 4 is a side view showing a trigger, sear link, sear, disconnector, and disconnector catch, where the operational rod is held in the rearward position by engagement with the sear, in accordance with an embodiment of the present disclosure.
Figure 5:
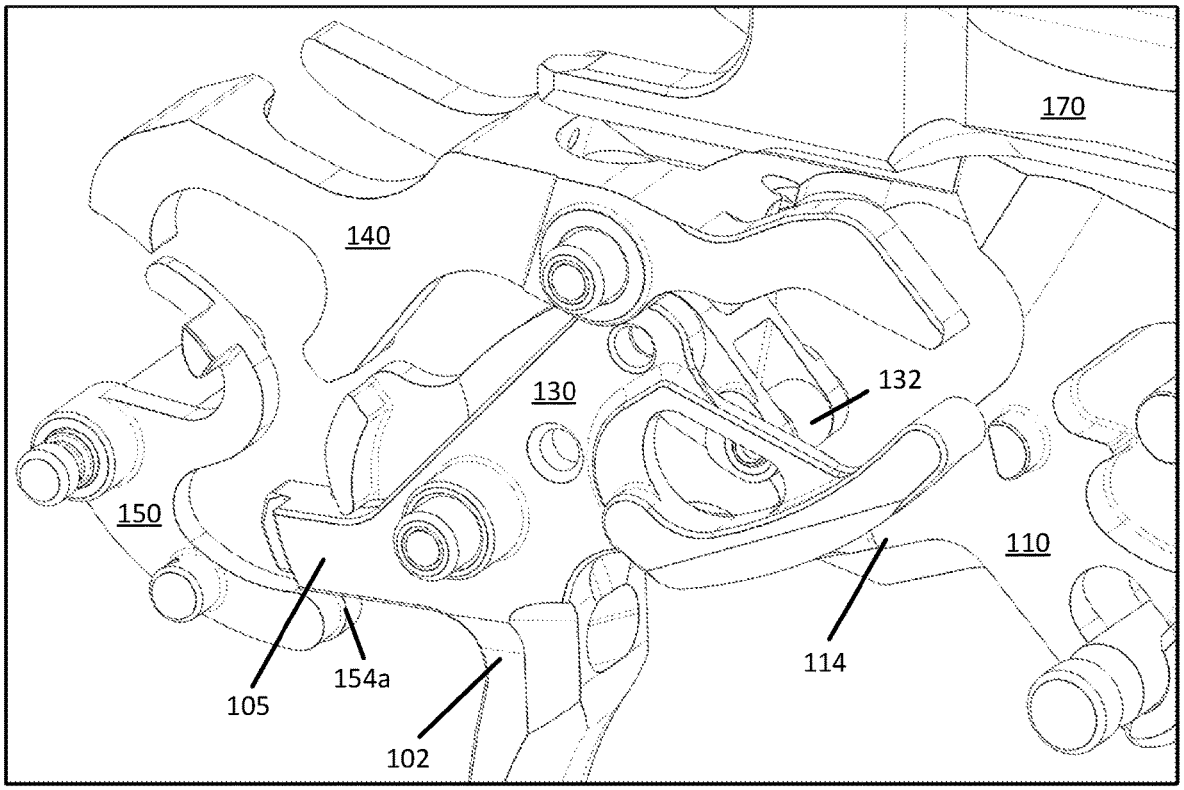
FIG. 5 illustrates a top and front perspective view showing part of the trigger, sear, disconnector, sear link, and disconnector catch of FIG. 4.
Figure 13:
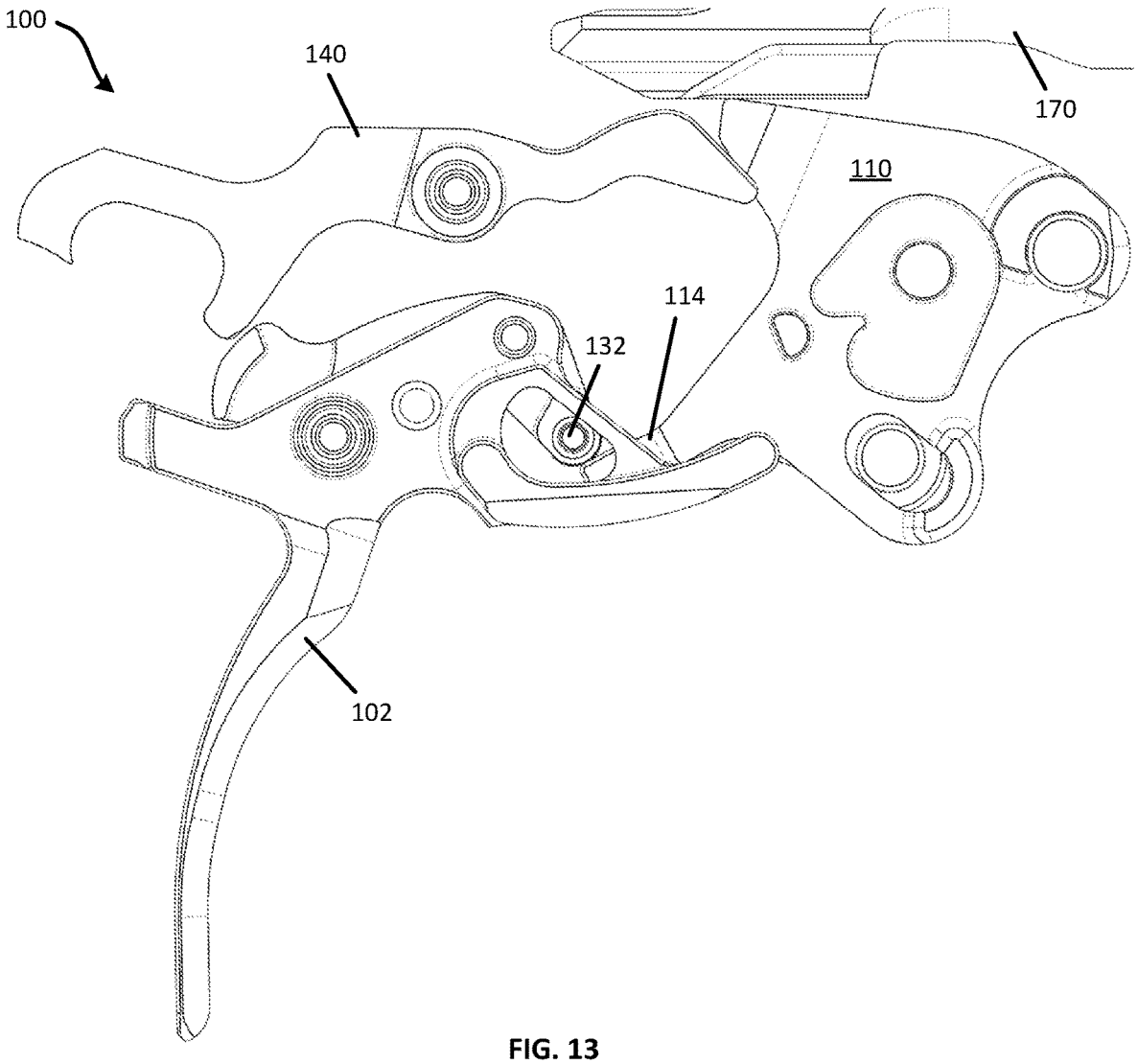
FIG. 13 illustrates a side view showing the trigger assembly with the selector in an automatic fire position, with the trigger pulled so that the sear link pivots the sear to the disengaged or fired position, and the operational rod having moved slightly forward, in accordance with an embodiment of the present disclosure.

FIG. 4 is a side view showing a trigger 102, sear link 130, sear 110, disconnector 140, and disconnector catch 150, in accordance with an embodiment of the present disclosure. In this example, the sear 110 engages the operational rod 170 and other components have positions consistent with either the safe or automatic fire positions of the selector 202, in accordance with an embodiment. FIG. 5 illustrates a top and front perspective view of the components shown in FIG. 4. In this example, the trigger 102 is at rest with the lower or first boss 154*a* engaging the bottom of the trigger blade 105. The disconnector 140 is disengaged from the sear link 130 and from the disconnector catch 150. In other words, the disconnector 140 is pivoted to a position where it is inactive with respect to a trigger pull, but as shown in FIG. 13, it can still block the sear link from disconnecting from the sear 110. The roller 132 on the sear link 130 is spaced from the rear leg 114 of the sear 110.

Figure 6A:
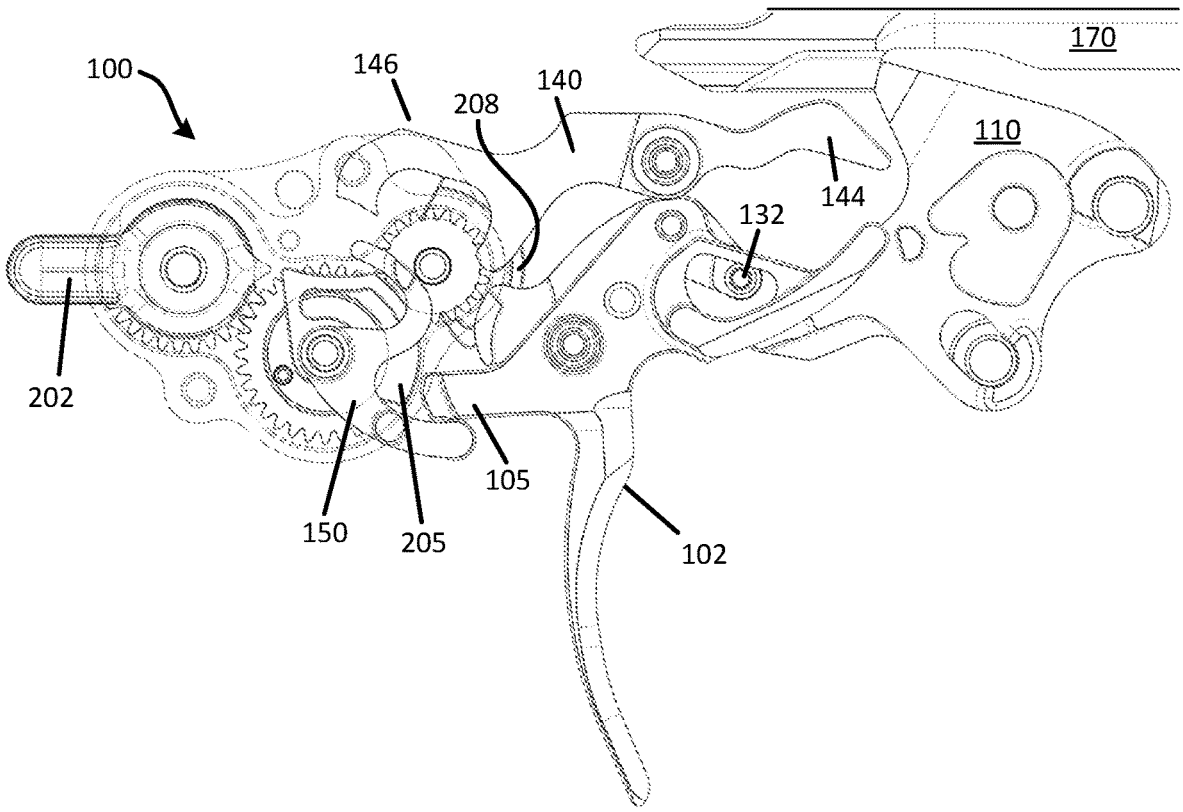
FIGS. 6A and 6B illustrate a side view and a front perspective view, respectively, showing components of a trigger assembly with the selector in a safe position and the sear engaging the operational rod, in accordance with an embodiment of the present disclosure.
Figure 6B:
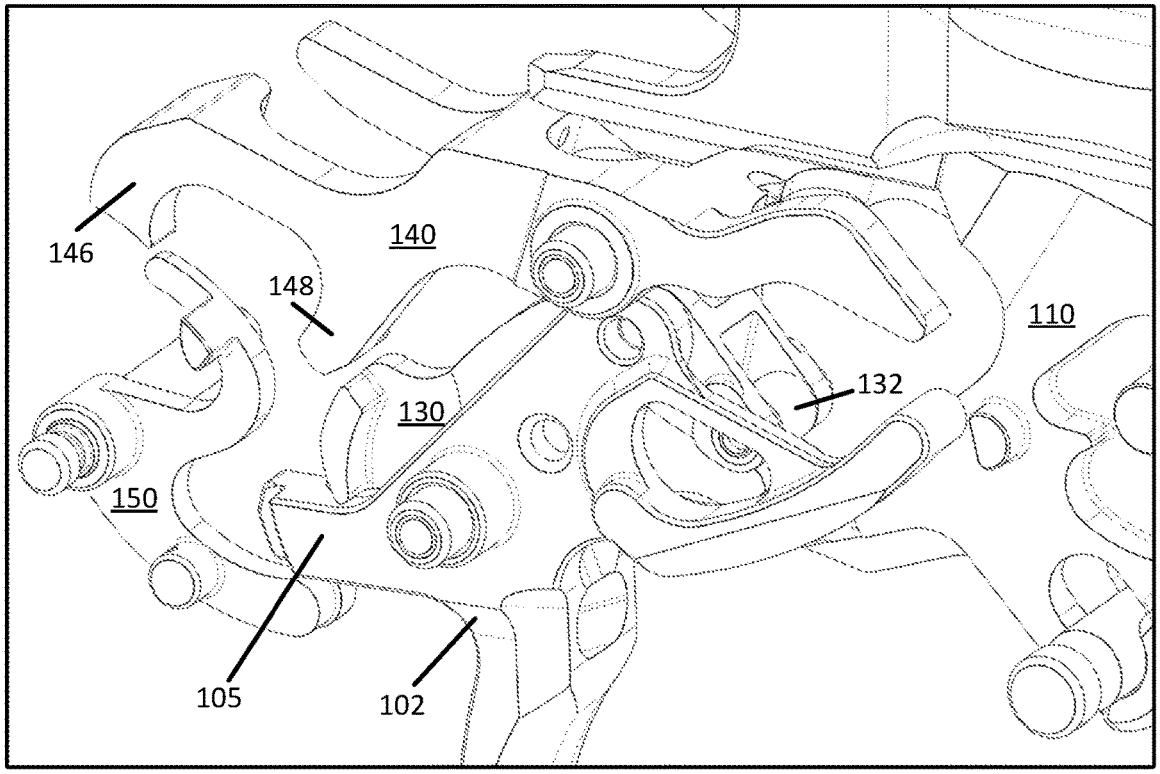

FIGS. 6A and 6B illustrate a side view and a front perspective view, respectively, showing components of a trigger assembly 100 with the selector 202 in a safe position and the sear 110 engaging the operational rod 170 to retain it in a rearward or cocked position, in accordance with an embodiment of the present disclosure. When the selector 202 is in the safe position, the trigger block 205 is positioned to contact the end of the trigger blade 105, preventing the trigger 102 from moving to the pulled position. Cam 208 has pivoted the disconnector 140 so that the fore portion 144 is below the path of the operational rod 170, the aft portion 146 is disengaged from the disconnector catch 150, and the downward leg 148 is disengaged from the sear link 130. The roller 132 is spaced from the sear 110 by a gap. In the event of a drop or other impulse, the roller 132 is not in contact with the sear 110 and therefore reduces the likelihood of the sear 110 disengaging from the operational rod 170. Although the disconnector 140 is shown in this example as being below the path of the operational rod 170 when the selector 202 is in the safe position, the disconnector 140 can be in the path of the operational rod 170, out of the path of the operational rod 170, or any in-between position when the selector 202 is in the safe position.

Figure 7A:
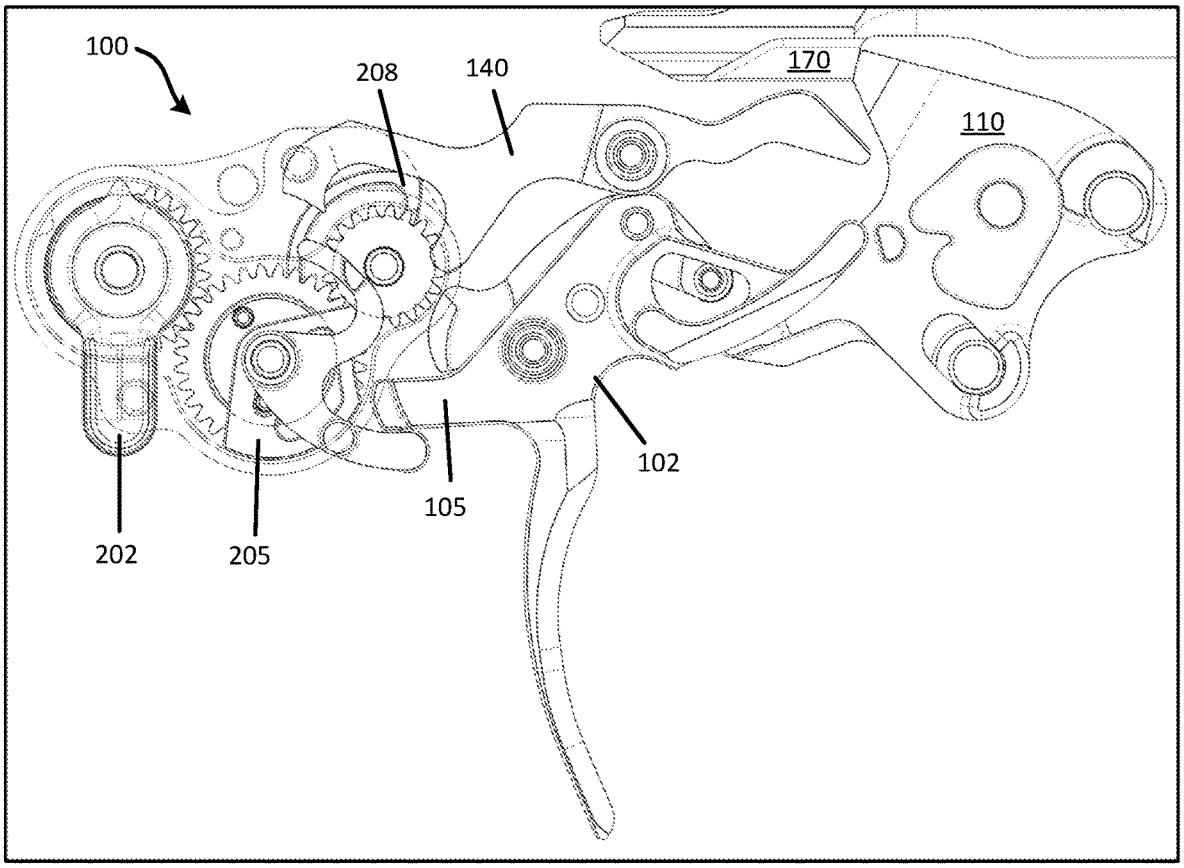
FIGS. 7A and 7B illustrate a side view and a front perspective view, respectively, showing components of a trigger assembly with the selector in an automatic fire position and the sear engaging the operational rod, in accordance with an embodiment of the present disclosure.
Figure 7B:
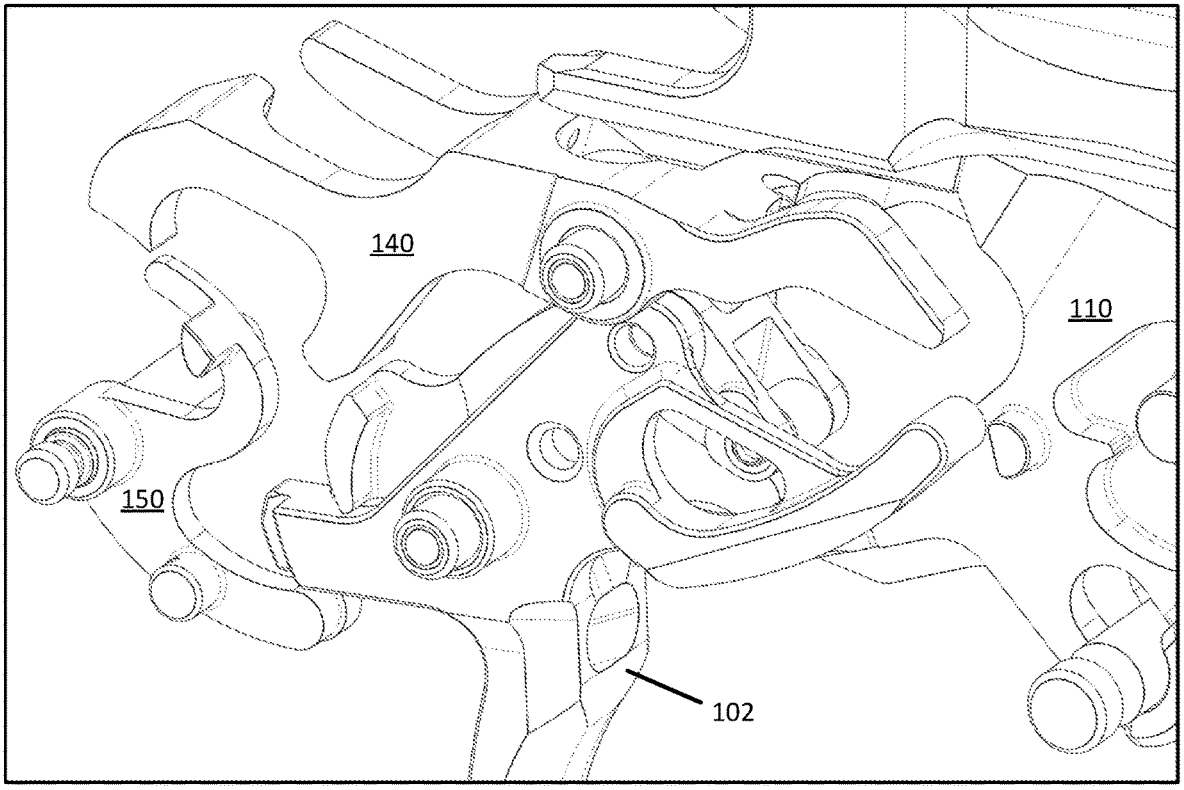

FIGS. 7A and 7B illustrate a side view and a front perspective view, respectively, showing components of a trigger assembly 100 with the selector 202 in an automatic fire position, in accordance with an embodiment of the present disclosure. In this example, the operational rod 170 is retained in a cocked or rearward position by engagement with the sear 110. Compared to the safe position shown in FIGS. 6A-6B, moving the selector 202 to the automatic fire position has rotated the trigger block 205 out of the way of the trigger blade 105, allowing the trigger 102 to be pulled. During this movement of the selector 202 from safe to automatic fire, the circular surface of the trigger block 205 inhibits trigger pull until the selector 202 has moved nearly completely to the automatic fire position, in accordance with some embodiments. Note that the disconnector 140 remains in the same position as when the selector 202 is in the safe position—the curved surface along the larger radius of the cam 208 has rotated, but the radius of the cam 208 when the selector 202 is in the safe position or in the automatic fire positions is the same or results in the same functional position of the disconnector 140.

Figure 8A:
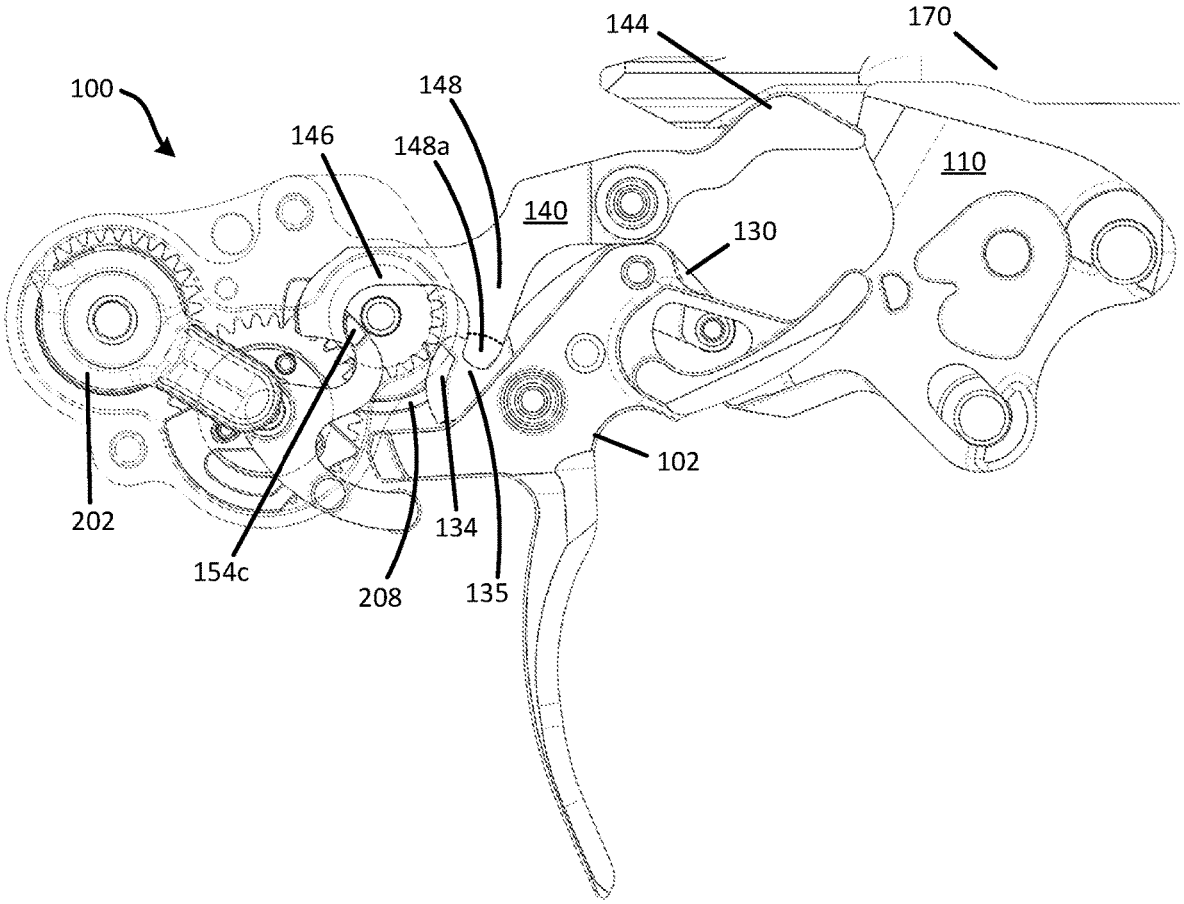
FIGS. 8A and 8B illustrate a side view and a front perspective view, respectively, showing components of a trigger assembly with the selector in a semiautomatic fire position and the sear engaging the operational rod, in accordance with an embodiment of the present disclosure.
Figure 8B:
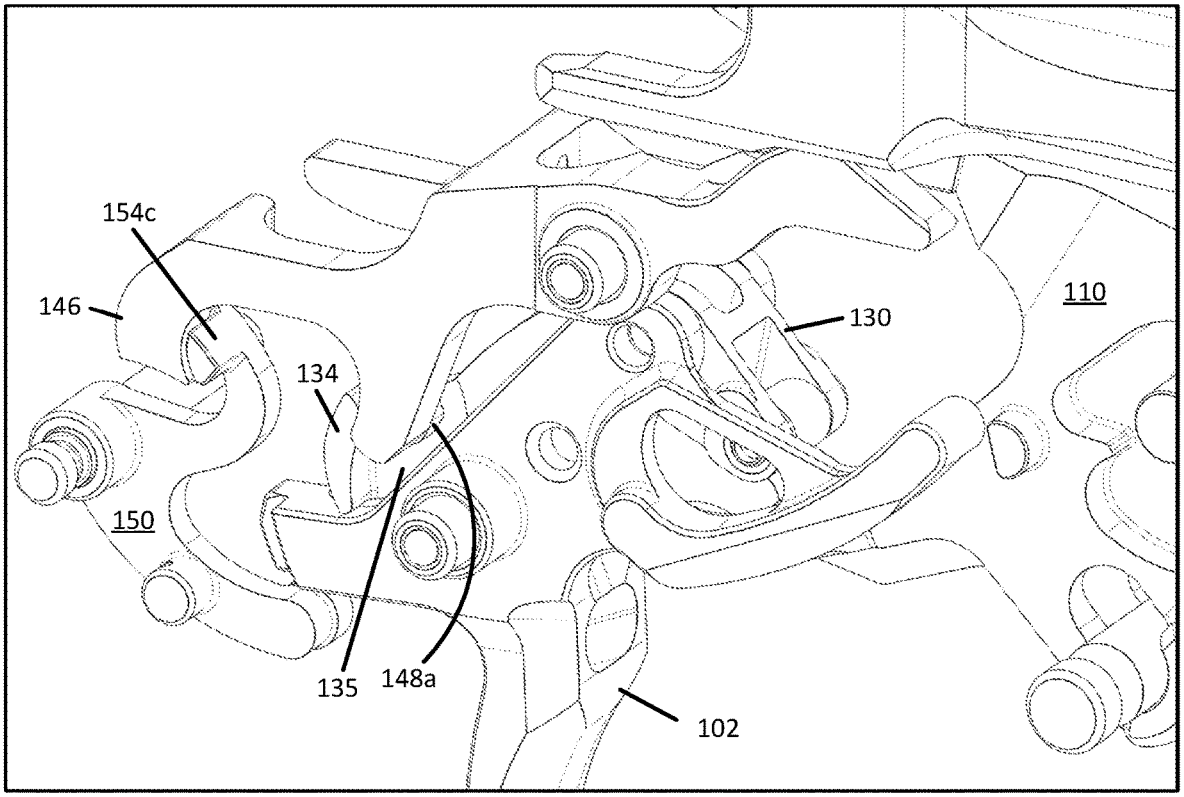

FIGS. 8A and 8B illustrate a side view and a front perspective view, respectively, showing components of a trigger assembly 100 with the selector 202 in a semiautomatic fire position, in accordance with an embodiment of the present disclosure. The operational rod 170 is retained in the cocked or rearward position by engagement with the sear 110. Moving the selector 202 to the semiautomatic fire position has caused the aft portion 146 of the disconnector to drop due to contact at a reduced radius of the cam 208, and has caused the fore portion 144 of the disconnector 140 to pivot upward to engage the operational rod 170. In this position, the downward leg 148 of the disconnector 140 is positioned to engage the catch 134 on the sear link 130. More specifically, a boss 148*a* on the end of the downward leg 148 is positioned in a pocket 135 formed in part by the catch 134 on the sear link 130. The aft portion 146 of the disconnector engages the upper or third boss 154*c* on the disconnector catch 150. The trigger block 205 has rotated further (counterclockwise as viewed in FIG. 8A) to a position permitting trigger pull.

Figure 9A:
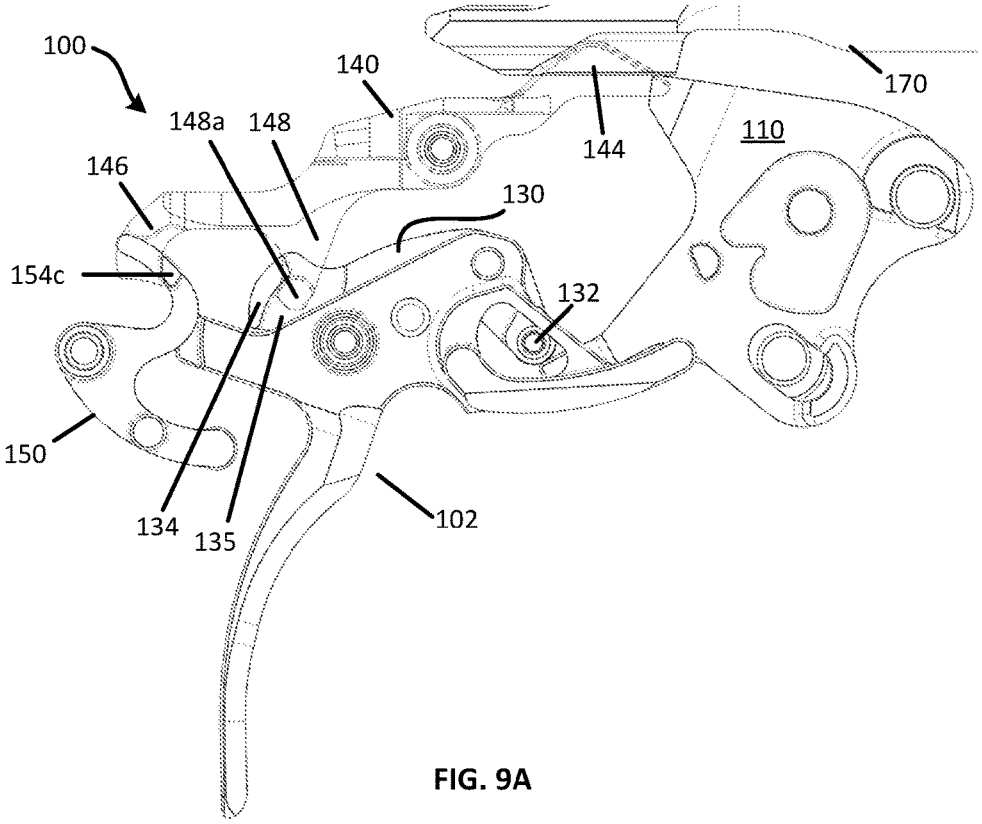
FIGS. 9A and 9B illustrate a side view and a front perspective view, respectively, showing components of a trigger assembly with the selector in a semiautomatic fire position, the trigger pulled rearward sufficiently to disengage the sear from the operational rod, and the operational rod having started moving forward, in accordance with an embodiment of the present disclosure.
Figure 9B:
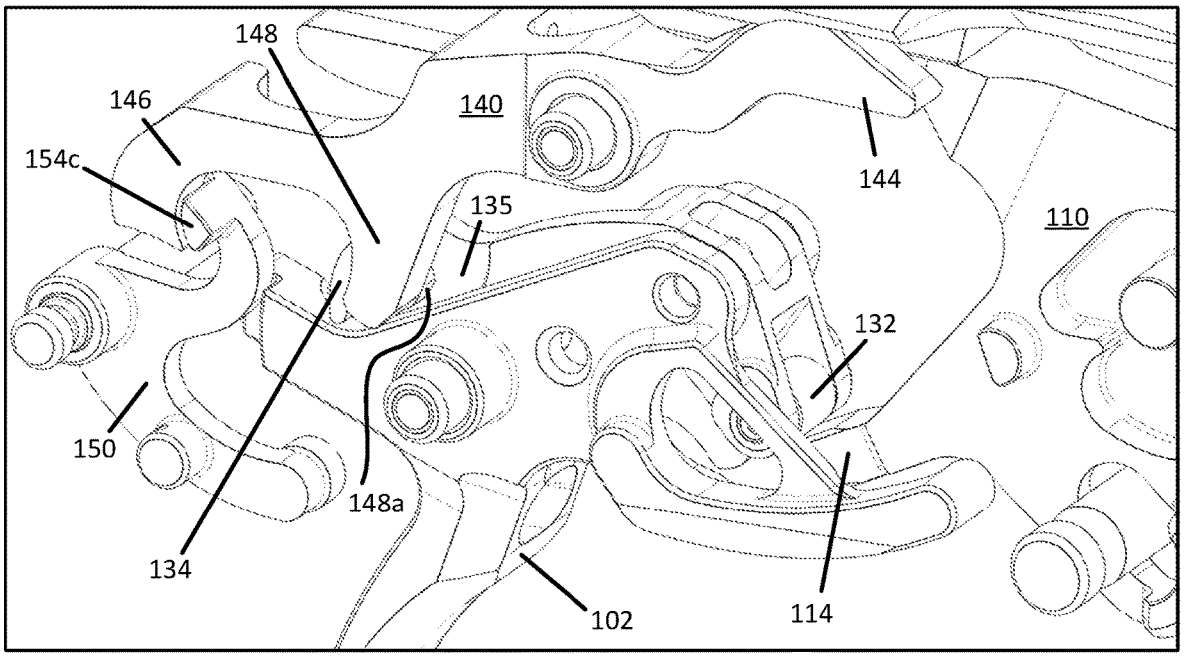

FIGS. 9A and 9B illustrate a side view and a front perspective view, respectively, showing components of a trigger assembly 100 with the selector 202 in a semiautomatic fire position and with the trigger 102 pulled rearward sufficiently to disengage the sear 110 from the operational rod 170 so that the operational rod 170 has started moving forward, in accordance with an embodiment of the present disclosure. Pulling the trigger 102 has caused the roller 132 on the sear link 130 to contact the sear 110 and pull it down to release the operational rod 170. Note that the roller 132 is at or near the end of the rear leg 114 of the sear 110. At the beginning of movement of the operational rod 170 as shown here, the fore portion 144 of the disconnector 140 contacts the operational rod 170. In this position, the upper or third boss 154*c* on the disconnector catch 150 remains in contact with the aft portion 146 of the disconnector 140. The boss 148*a* on the downward leg 148 of the disconnector 140 remains in the pocket 135 and engages the catch 134 on the sear link 130. As the operational rod 170 continues its forward movement, it will cause the disconnector 140 to rotate clockwise, lifting the boss 148*a*. Engagement between the catch 134 and the boss 148*a* rotates the sear link 130 clockwise, disengaging it from contact with the end of the sear leg 114, thus releasing the sear 110 and allowing it to return to its upward or engaged position.

Figure 10A:
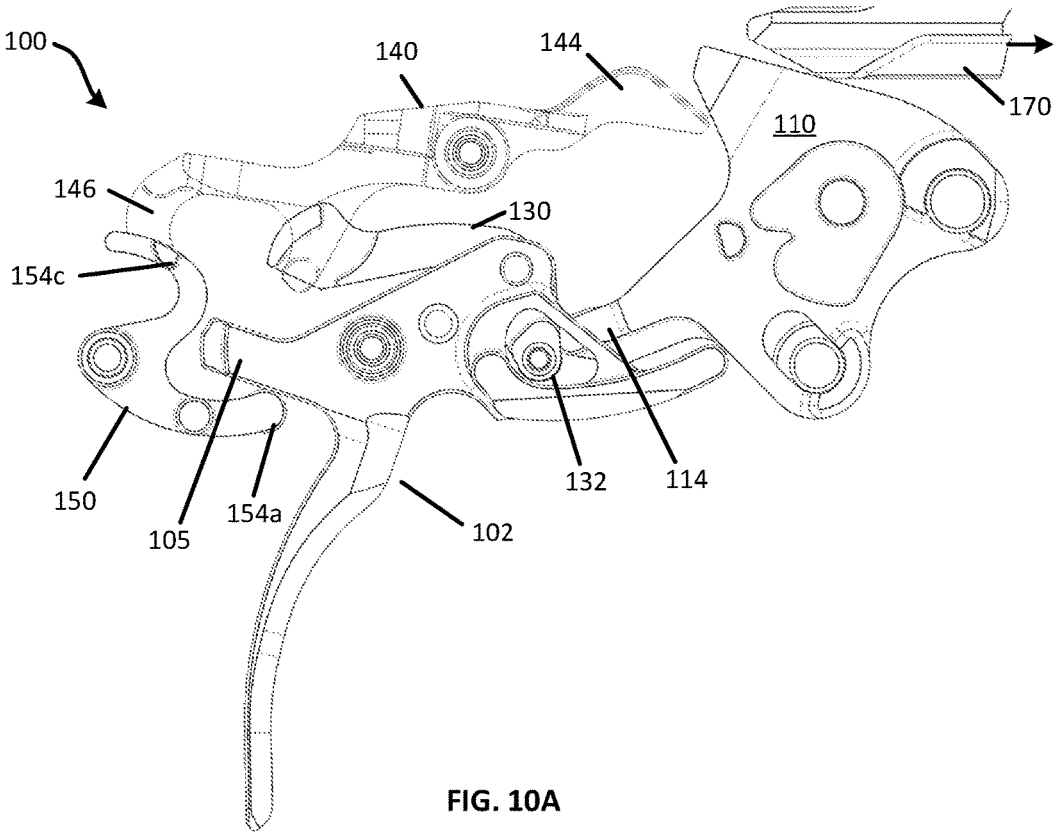
FIGS. 10A and 10B illustrate a side view and a front perspective view, respectively, showing components of a trigger assembly with the selector in a semiautomatic fire position, the trigger having been pulled fully, and the operational rod having moved forward beyond the sear and disconnector, in accordance with an embodiment of the present disclosure.
Figure 10B:
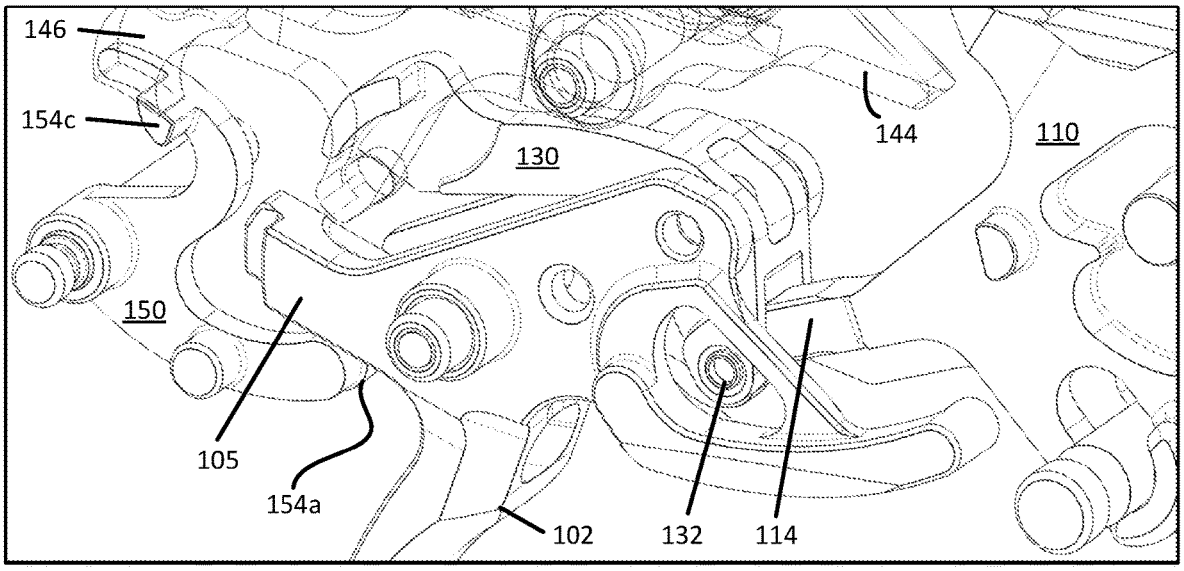

FIGS. 10A and 10B illustrate a side view and a front perspective view, respectively, showing components of a trigger assembly 100 with the selector in the semiautomatic fire position and after the trigger 102 has been pulled, in accordance with an embodiment of the present disclosure. In this example, the trigger 102 has been pulled fully to the pulled position. The operational rod 170 has moved forward beyond the sear 110 and disconnector 140, and the sear 110 has reset upward to its resting position due to sear spring 112 (shown in FIG. 2). The roller 132 on the sear link 130 has traveled off the end of the rear leg 114 of the sear 110, disengaging from the sear 110 and allowing the sear 110 to reset while the trigger 102 remains pulled. The fore portion 144 of the disconnector 140 has been pushed down by the operational rod 170, resulting in the aft portion 146 releasing the disconnector catch 150 so that the lower or first boss 154*a* on the disconnector catch 150 engages the bottom of the trigger blade 105. The upper or third boss 154*c* on the disconnector catch 150 rotates under the aft portion 146 of the disconnector 140, preventing it from resetting with the fore portion 144 upward in the path of the operational rod 170. By doing so, the operational rod 170 will return rearward before the trigger 102 resets, therefore avoiding contact or allowing only a reduced contact between the operational rod 170 and disconnector 140. Accordingly, wear on the disconnector 140 is reduced. Contact of the operational rod 170 with the disconnector 140 during rearward travel also consumes some of the energy of the recoil forces, so reducing or eliminating the contact helps to avoid a short cycle or failure to cycle condition in which the operational rod 170 fails to return rearward past the disconnector 140. The upward position of the boss 148*a* where it engages the catch 134 keeps the sear link 130 in rotated position, thus preventing it from reconnecting with the rear leg 114 of the sear 110 when the sear 110 is pushed down by returning operational rod 170.

Figure 11:
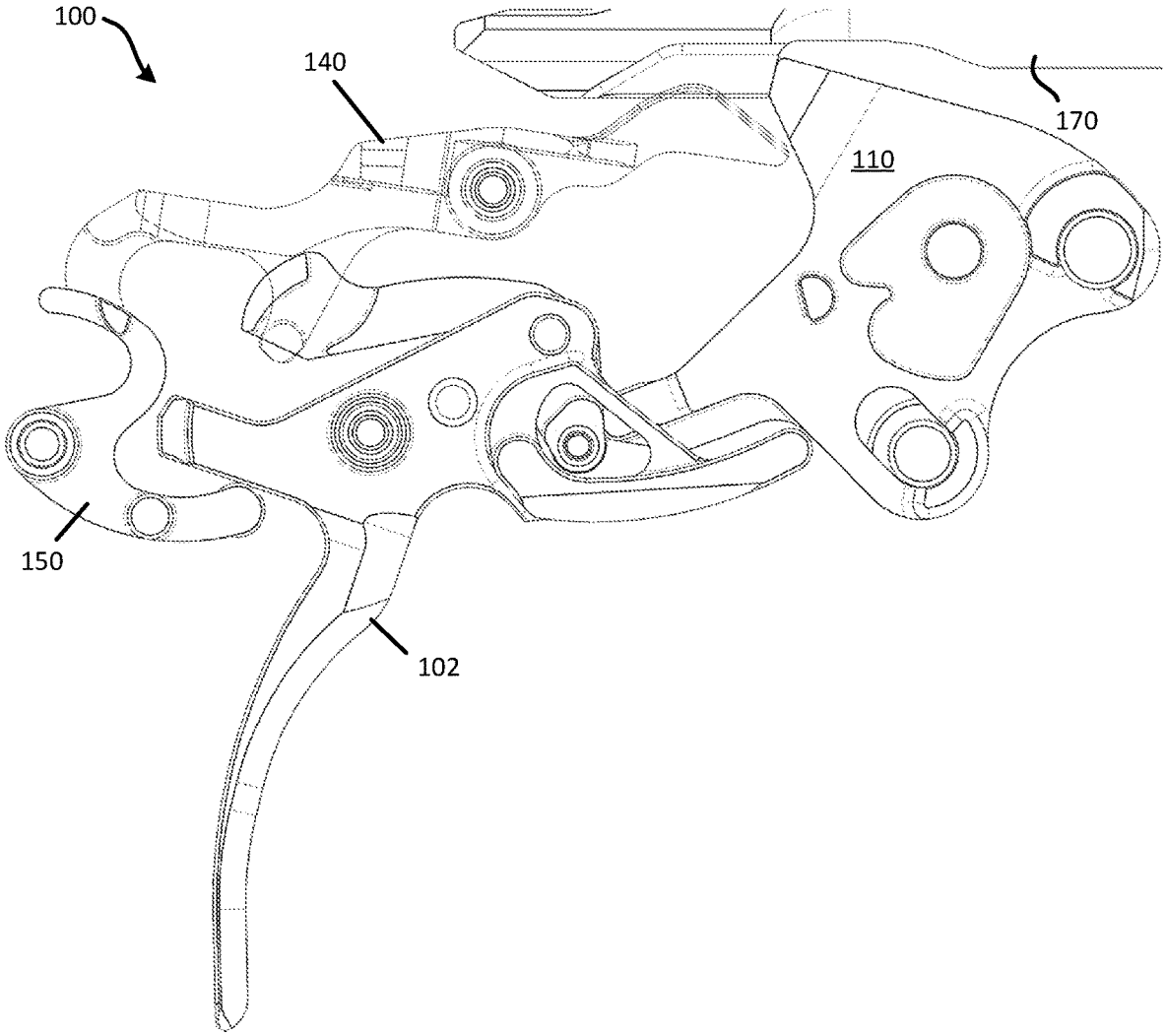
FIG. 11 illustrates a side view showing the trigger assembly with the selector in a semiautomatic position, the trigger pulled, and after the operational rod has returned rearward and reengaged with the sear, in accordance with an embodiment of the present disclosure.

FIG. 11 illustrates a side view showing the trigger assembly 100 in a semiautomatic position with the trigger 102 pulled and the operational rod 170 returned rearward and reengaged with the sear 110, in accordance with an embodiment of the present disclosure. In this example, the operational rod 170 has returned rearward due to gas piston forces and now engages the sear 110 where it is held until the next trigger pull. The disconnector catch 150 prevents the disconnector 140 from fully resetting when the trigger 102 remains in the pulled position. Note that the sear link 130 has pivoted clockwise with respect to the trigger 102. Absent the disconnector catch 150, it is possible for the disconnector 140 to return toward the engaged position during the return stroke of the operational rod 170, enabling the sear link 130 to reengage the sear 110 and fire the gun again. The disconnector catch 150 prevents such occurrence by not allowing the disconnector 140 to return fully to the engaged position, and therefore, the sear link 130 does not rotate to the resting position.

Figure 12A:
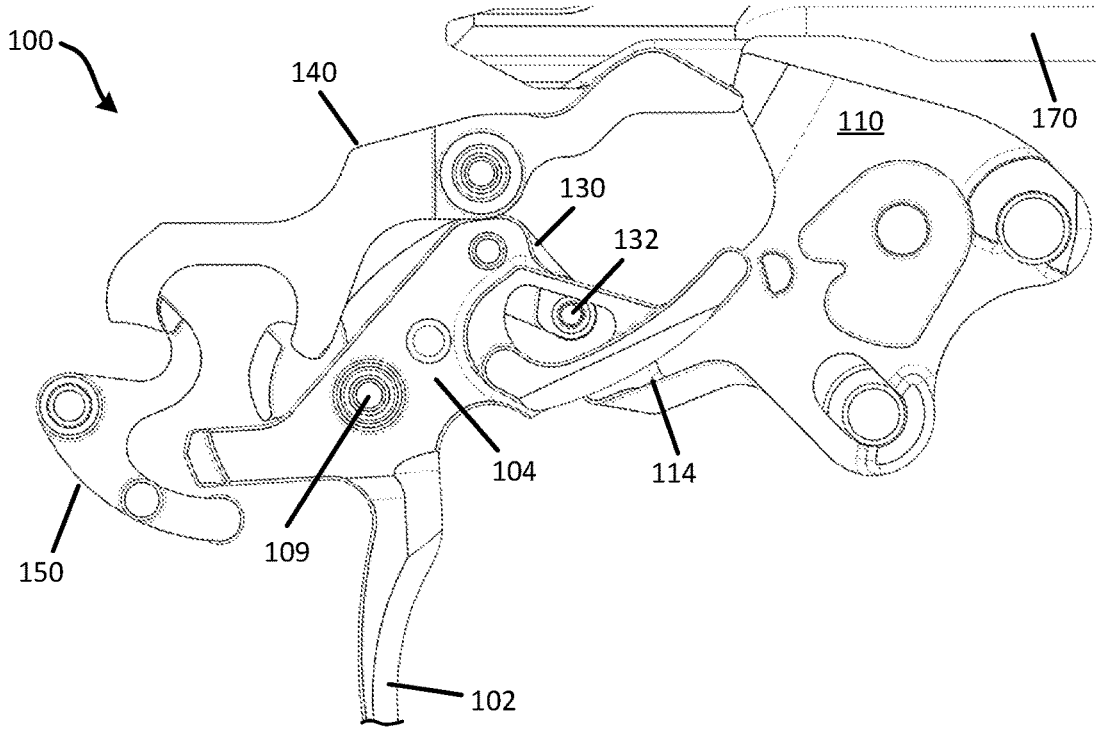
FIGS. 12A and 12B illustrate a side view and a front perspective view, respectively, showing the trigger assembly in a ready-to-fire condition with the selector in a semiautomatic position, the trigger having reset forward, the disconnector having reset, and the operational rod engaging the sear, in accordance with an embodiment of the present disclosure.
Figure 12B:
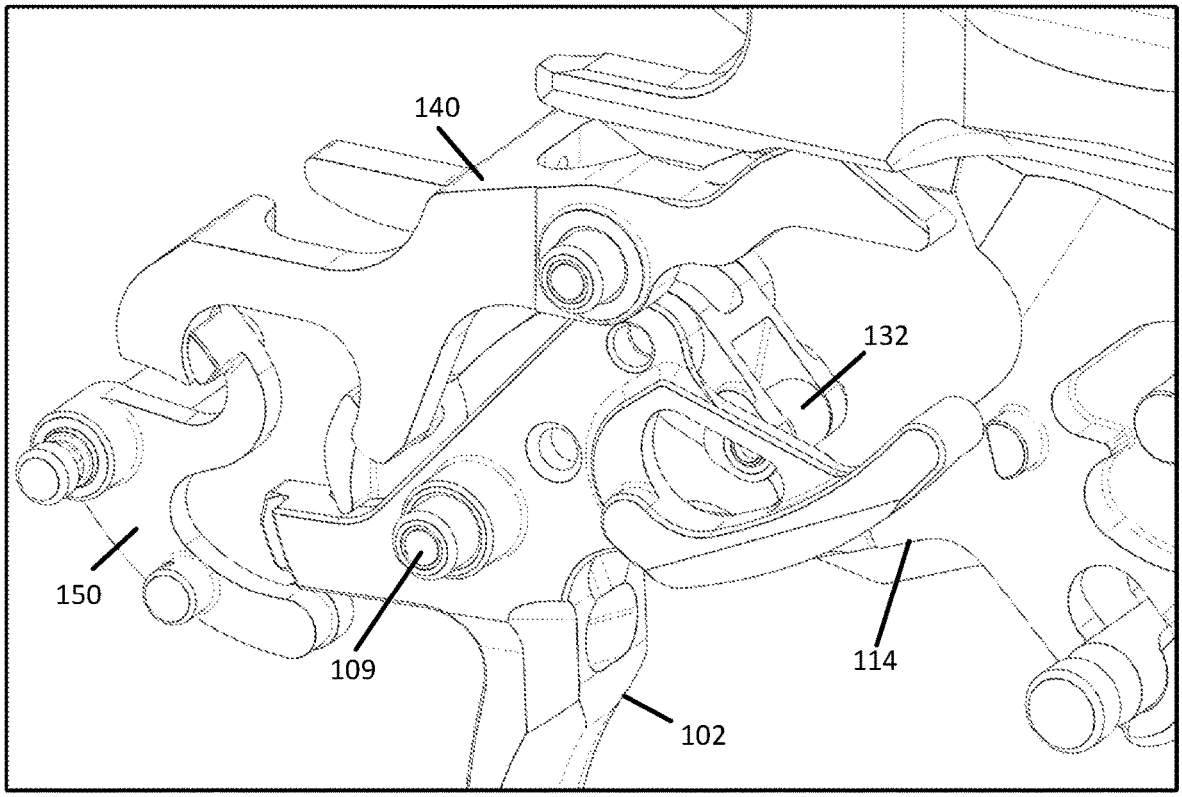

FIGS. 12A and 12B illustrate a side view and a front perspective view, respectively, showing components of the trigger assembly 100 after trigger 102 reset, in accordance with an embodiment of the present disclosure. Similar to the assembly shown in FIG. 8A, the trigger assembly 100 is in a ready-to-fire condition with the selector 202 in the semiautomatic position. Also, the trigger 102 has reset to the forward position and the sear 110 engages and retains the operational rod 170 in a cocked position. The disconnector 140 has reset and returned to its default position with respect to the operational rod 170. The sear link 130 has also reset with the roller 132 now positioned above the rear leg 114 of the sear 110 and the body of the sear link 130 pivoted down against the trigger pin 109. In some embodiments, the gap between the roller 132 and the rear leg 114 of the sear 110 is necessary so that the roller 132 can reset to be on top of the rear leg 114. In some embodiments, the disconnector 140 and the sear link 130 reset simultaneously.

FIG. 13 illustrates a side view showing the trigger assembly 100 with the selector 202 in an automatic fire position, in accordance with an embodiment of the present disclosure. In this example, the trigger 102 is pulled sufficiently so that the sear link 130 contacts the sear 110 and pivots the sear 110 to disengage from the operational rod 170, thereby releasing the operational rod 170 forward. As noted above, in the automatic fire condition, the disconnector 140 is pivoted so as to not be in the path of the operational rod 170 and to not be involved in the trigger pull or return to the resting position. The position of the disconnector boss 148*a* outside of the sear link catch 134 further prevents the sear link from unintentionally disconnecting from the rear leg 114 of the sear 110.

Figure 14:
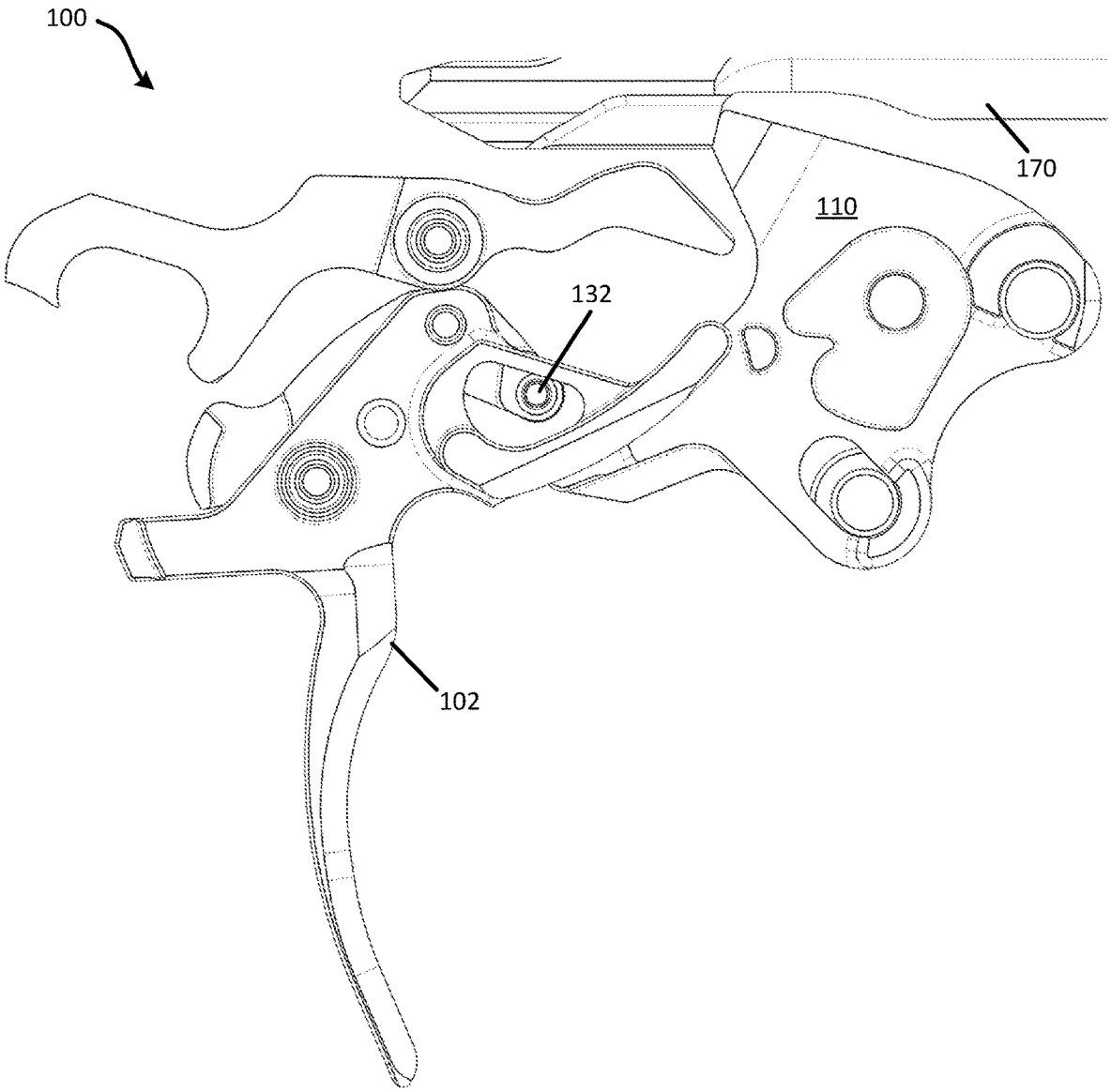
FIG. 14 illustrates a side view showing the trigger assembly with the selector in an automatic fire position, with the trigger released forward so that the sear link has disengaged from the sear, and the sear engaging the operational rod, in accordance with an embodiment of the present disclosure.

FIG. 14 illustrates a side view showing the trigger assembly 100 in an automatic fire position after trigger return, in accordance with an embodiment of the present disclosure. In this example, the trigger 102 has returned forward and the roller 132 has resumed its position above the rear leg 114 of the sear 110.

Figure 15A:
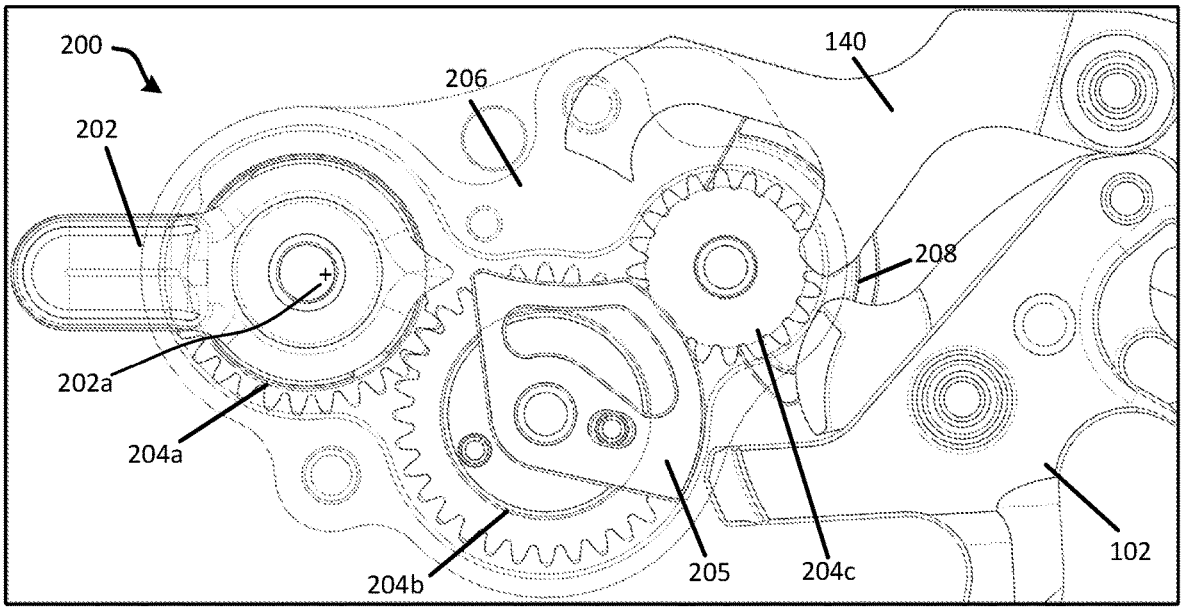
FIGS. 15A and 15B illustrate a side view and a perspective view, respectively, showing components of a selector assembly with a gearcase, in accordance with an embodiment of the present disclosure.
Figure 15B:
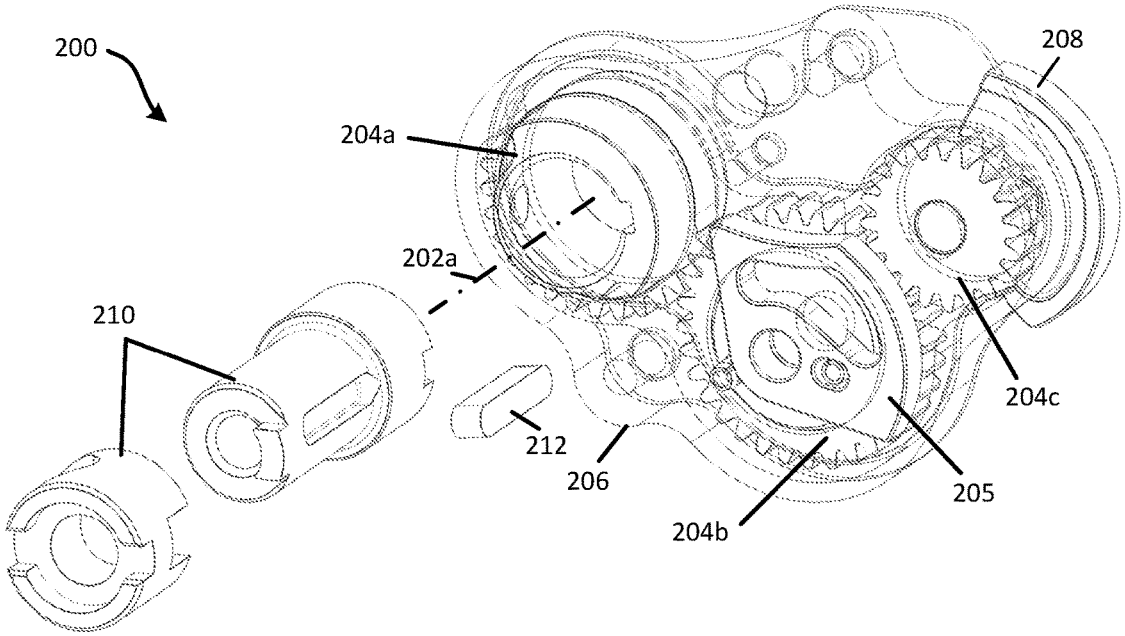

FIGS. 15A and 15B illustrate a side view and a perspective view, respectively, showing components of a selector assembly 200 that utilizes gear operation, in accordance with an embodiment of the present disclosure. The selector 202 is rotatable about an axis 202*a* of rotation. A first gear 204*a* is concentric with the axis 202*a* of rotation. In one embodiment, the selector 202 is assembled with the first gear 204*a* using a barrel assembly that includes a two-part barrel 210 that is received through an opening of the first gear 204*a*. A key 212 is received in a slot and couples the barrel 210 to the first gear 204*a* so that rotating the selector 202 also rotates the first gear 204*a*. A fastener or pin (not shown) can extend through the selector 202, barrel 210, and first gear 204*a* to secure the lever to the first gear 204*a*. The first gear 204*a* has teeth that mesh with and rotate a second gear 204*b*. The trigger block 205 is pinned to the second gear 204*b* and rotates together with the second gear 204*b*. Teeth on the second gear 204*b* mesh with and rotate a third gear 204*c*. The cam 208 is pinned to the third gear 204*c* and rotates with the third gear 204*c*. The cam 208 includes a portion of greater radius and a portion of smaller radius. The first gear 204*a* and third gear 204*c* rotate in a first rotational direction and the second gear 204*b* rotates in an opposite second rotational direction by virtue of the second gear 204*b* being between the first and third gears 204*a*, 204*c*.

In some embodiments, all or part of the first gear 204*a*, second gear 204*b*, and third gear 204*c* are retained within a gearbox 206. In some embodiments, the gearbox 206 has a clamshell geometry that can be secured closed with fasteners or other suitable mechanism. The gearbox 206 can be filled with grease to prevent intrusion of particles and other contaminants.

In operation, rotating the selector 202 causes rotation of the trigger block 205 and cam 208. The trigger block 205 results in either free or blocked trigger pull. Rotating the cam 208 changes the position of the disconnector 140 between a first position in which the fore portion 144 is in the path of the operational rod 170 and a second position in which the fore portion 144 is below the path of the operational rod 170. As noted above, in the first position the disconnector may engage the disconnector catch 150. In the second position, the disconnector 140 is not involved in trigger pull or return and the disconnector does not interact with the operational rod 170.

Figure 16A:
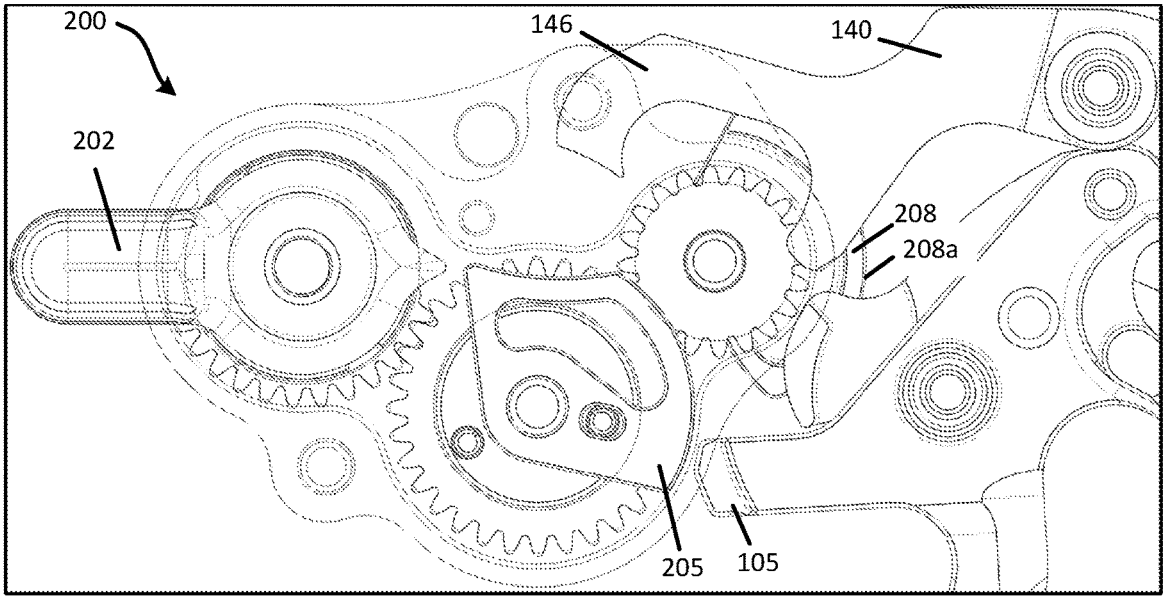
FIGS. 16A and 16B illustrate a right-side view and a perspective view of the left side, respectively, showing the selector assembly with the selector in a safe position, in accordance with an embodiment of the present disclosure.
Figure 16B:
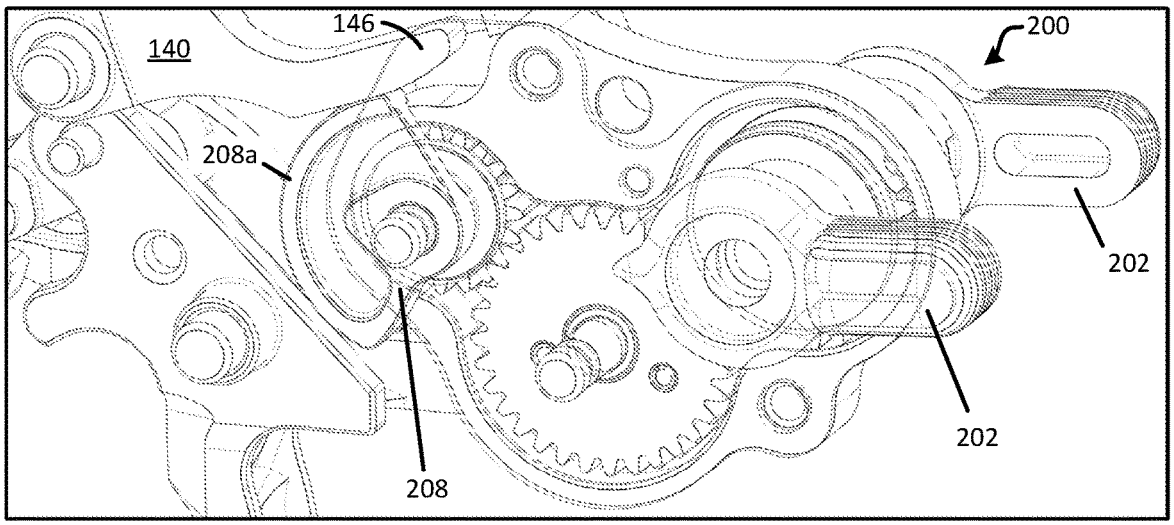

FIGS. 16A and 16B illustrate a right-side view and a perspective view of the left side, respectively, showing the selector 202 in a safe position, in accordance with an embodiment of the present disclosure. In this example the aft portion 146 of the disconnector 140 is lifted by the region of greater diameter 208*a* of cam 208, lowering the fore portion 144 below the path of the operational rod 170 (e.g., shown in FIG. 14). The trigger block 205 is positioned to interfere with the trigger blade 105 if an attempt to pull the trigger 102 is made.

Figure 17A:
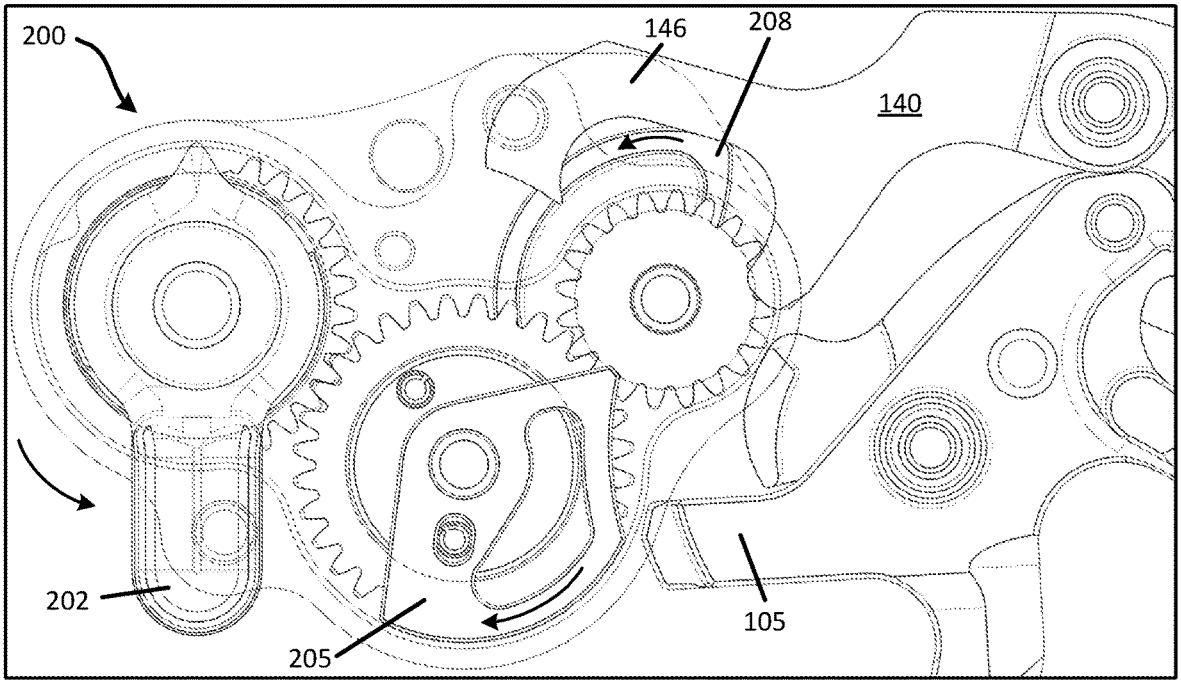
FIGS. 17A and 17B illustrate a right-side view and a perspective view of the left side, respectively, showing the selector assembly with the selector in an automatic fire position, in accordance with an embodiment of the present disclosure.
Figure 17B:
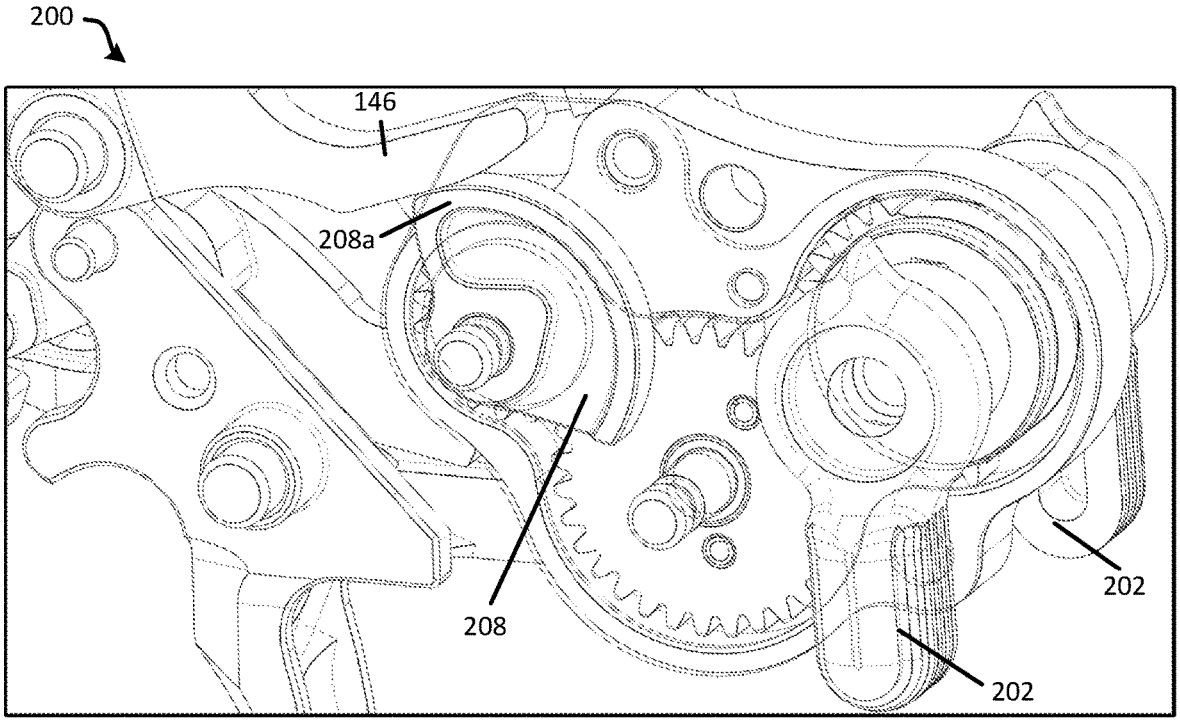

FIGS. 17A and 17B illustrate a right-side view and a perspective view of the left side, respectively, showing the selector assembly 200 with the selector 202 in an automatic fire position, in accordance with an embodiment of the present disclosure. In this example, rotating the selector 202 counterclockwise (as viewed in FIG. 17A) to the automatic fire position has rotated the cam 208 counterclockwise and the trigger block 205 clockwise. As a result, the aft portion 146 of the disconnector 140 remains lifted by contact with the region of greater diameter 208*a* of cam 208. The trigger block 205 is positioned to permit free travel of the trigger blade 105, thereby permitting a trigger pull to fire the rifle.

Figure 18A:
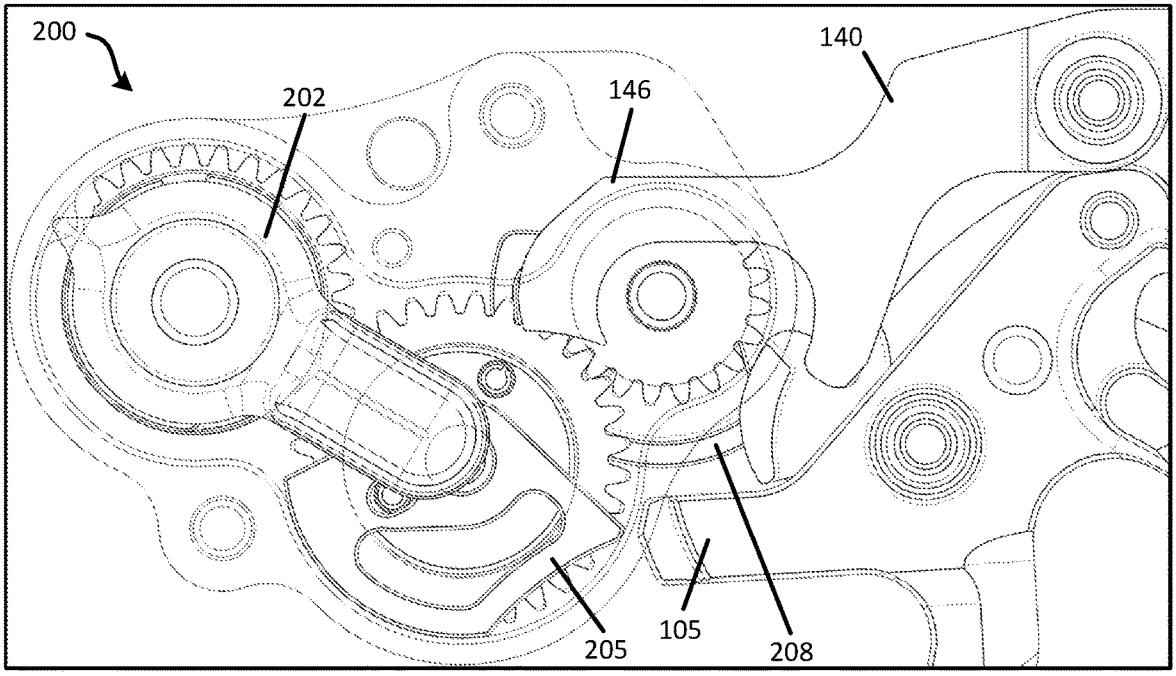
FIGS. 18A and 18B illustrate a right-side view and a perspective view of the left side, respectively, showing the selector assembly with the selector in a semiautomatic fire position, in accordance with an embodiment of the present disclosure.
Figure 18B:
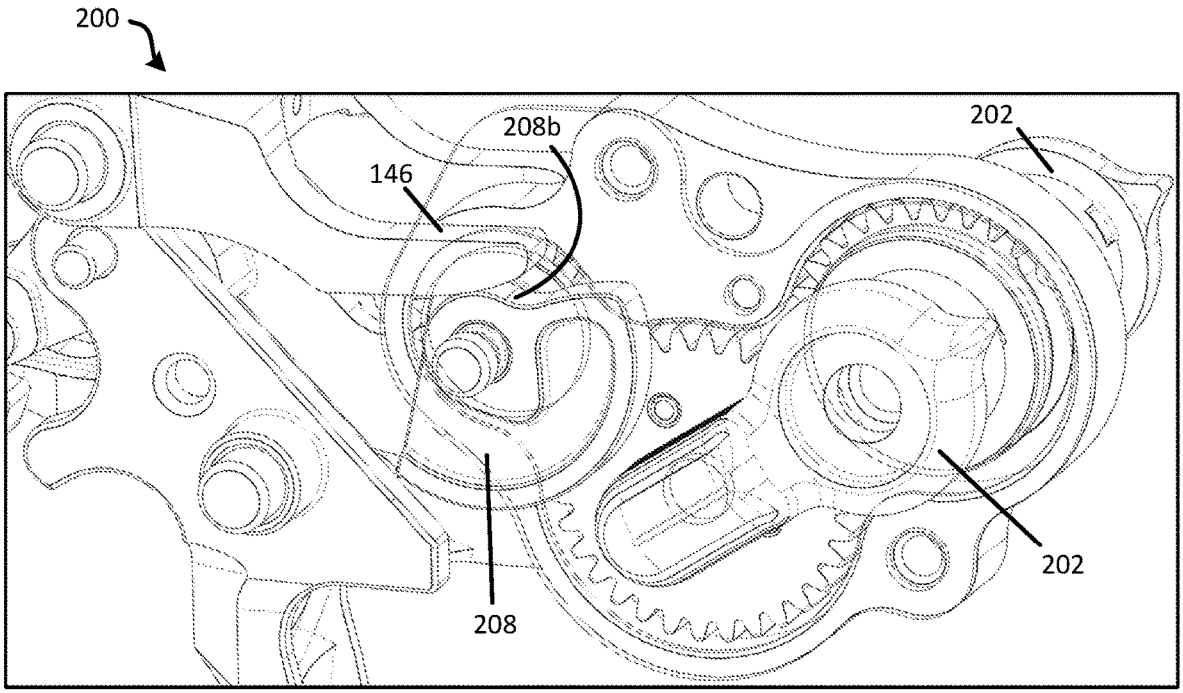

FIGS. 18A and 18B illustrate a right-side view and a perspective view of the left side, respectively, showing the selector assembly 200 with the selector 202 in a semiautomatic fire position, in accordance with an embodiment of the present disclosure. In this example, rotating the selector 202 to the semiautomatic fire position has further rotated the cam 208 counterclockwise (as viewed in FIG. 18A) and the trigger block 205 clockwise. As a result, the aft portion 146 of the disconnector 140 has been lowered due to contact with the region of lesser diameter 208*b* of cam 208. The fore portion 144 has been raised into the path of the operational rod 170 (shown in FIG. 8A). The trigger block 205 is now positioned to permit free travel of the trigger blade 105, thereby permitting a trigger pull to fire the rifle.

Figure 19A:
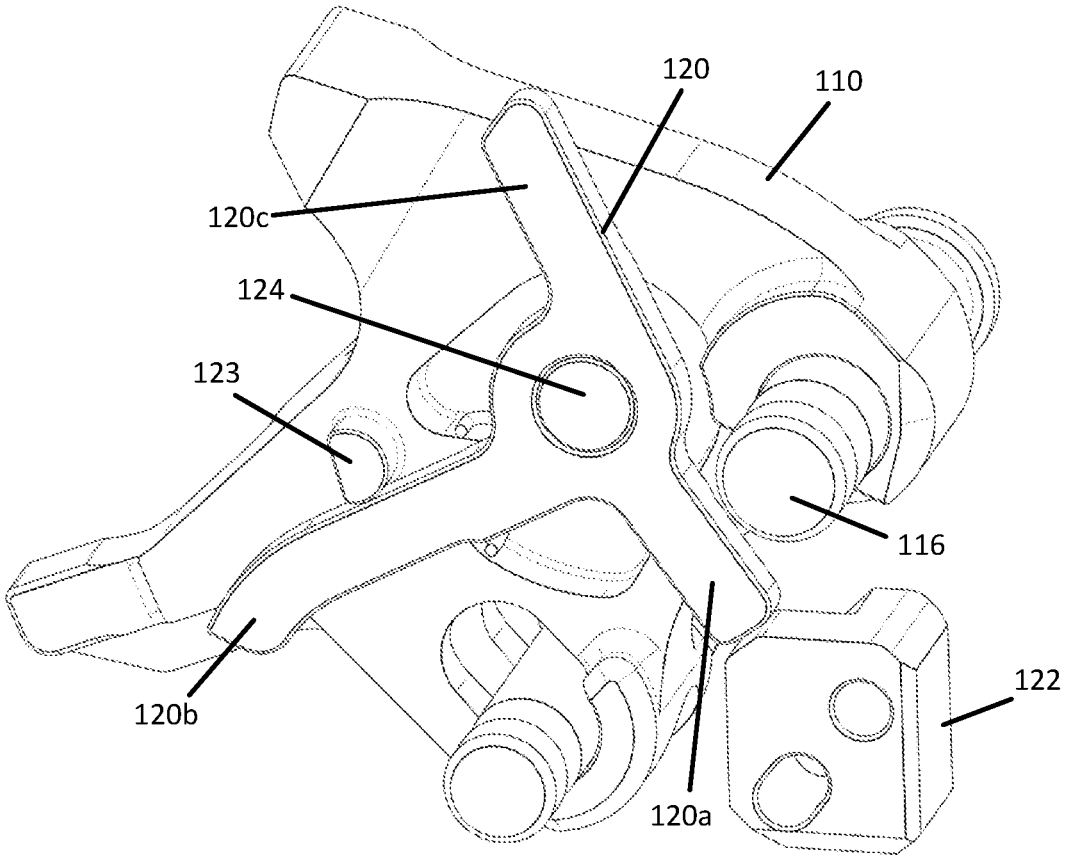
FIG. 19A illustrates a front and side perspective view showing a sear with a sear block in a blocking position, in accordance with an embodiment of the present disclosure.
Figure 19B:
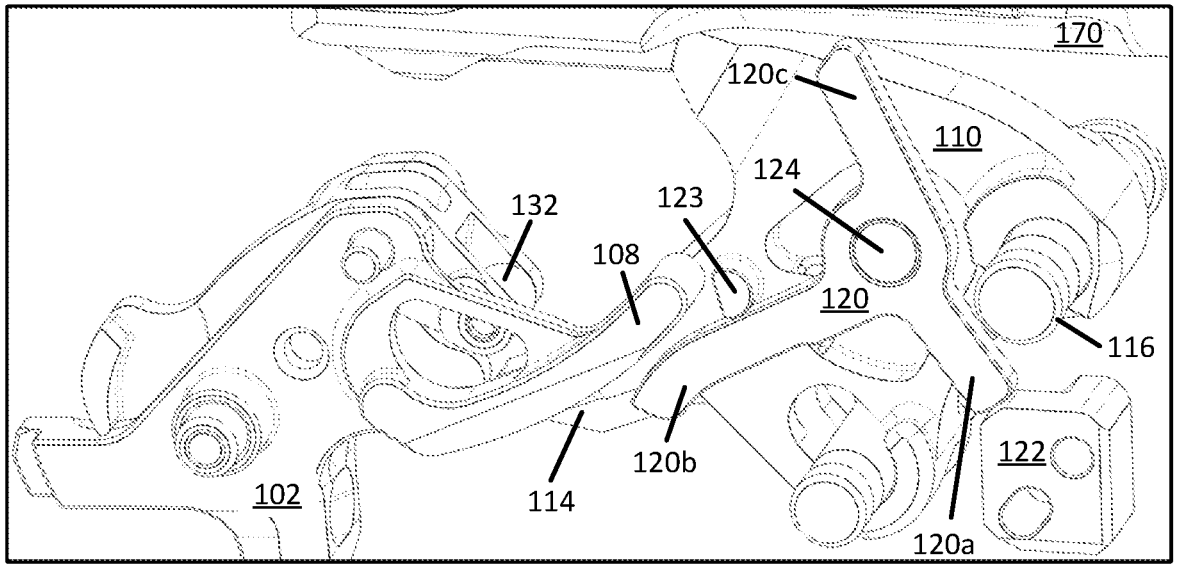
FIG. 19B illustrates a front and side perspective view showing components of the trigger assembly with the sear block in a blocking position, in accordance with an embodiment of the present disclosure.

FIG. 19A illustrates a perspective view showing a sear 110 and sear block 120, where the sear block 120 is in a blocking position, in accordance with an embodiment of the present disclosure. FIG. 19B illustrates a perspective view showing some components of the trigger assembly 100 with the sear block 120 in a blocking position, in accordance with an embodiment of the present disclosure.

The sear block 120 pivots about a pivot pin 124 that protrudes from a side face of the sear 110. The sear block 120 has arms 120*a*-120*c* that permit rotation of the sear block 120 between a boss 123 on the sear 110 and a sear pivot pin 116. As can be seen in FIG. 1, for example, the sear 110 pivots about the sear pivot pin 116. The sear block 120 includes a forward leg 120*a* that aligns in the blocking position with a block 122 on or attached to the trigger housing 60, a rearward leg 120*b* that is positioned to be actuated by the forward arm 108 of the trigger and that abuts the boss 123 on the sear 110 in the blocking position, and an upward leg 120*c* that extends into the path of the operational rod 170. A torsion spring biases the sear block 120 clockwise towards the blocking position, such that the rearward leg 120*b* rests against the boss 123, where the forward leg 120*a* aligns with the block 122 to block rotation of the sear 110 about the sear pin 116.

When the trigger 102 is at rest, such as shown in FIG. 19B, the forward arm 108 of the trigger 102 is spaced from the rearward leg 120*b* to reduce or eliminate the chance that the trigger 102 will move the sear block 120 to the non-blocking position in the event of a drop or other impulse. When the trigger is pulled, the forward arm 108 of the trigger 102 pivots down to engage the rearward leg 120*b* of the sear block 120 and rotates the sear block 120 to the non-blocking position, followed by the roller 132 contacting the rear leg 114 of the sear 110 pivoting the sear 110 out of engagement with the operational rod 170.

Figure 20A:
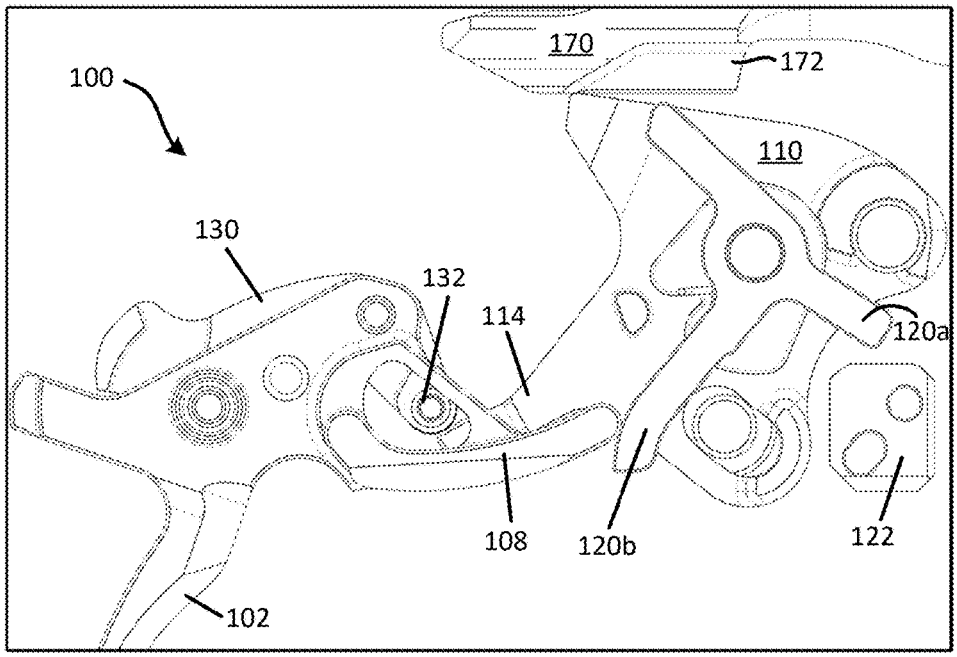
FIGS. 20A and 20B illustrate a side view and a perspective view, respectively, showing a sear, sear block, trigger, and sear link where the trigger has been pulled, causing the sear block to move to the unblocked position and the sear link to pivot the sear out of engagement with the operational rod, in accordance with an embodiment of the present disclosure.
Figure 20B:
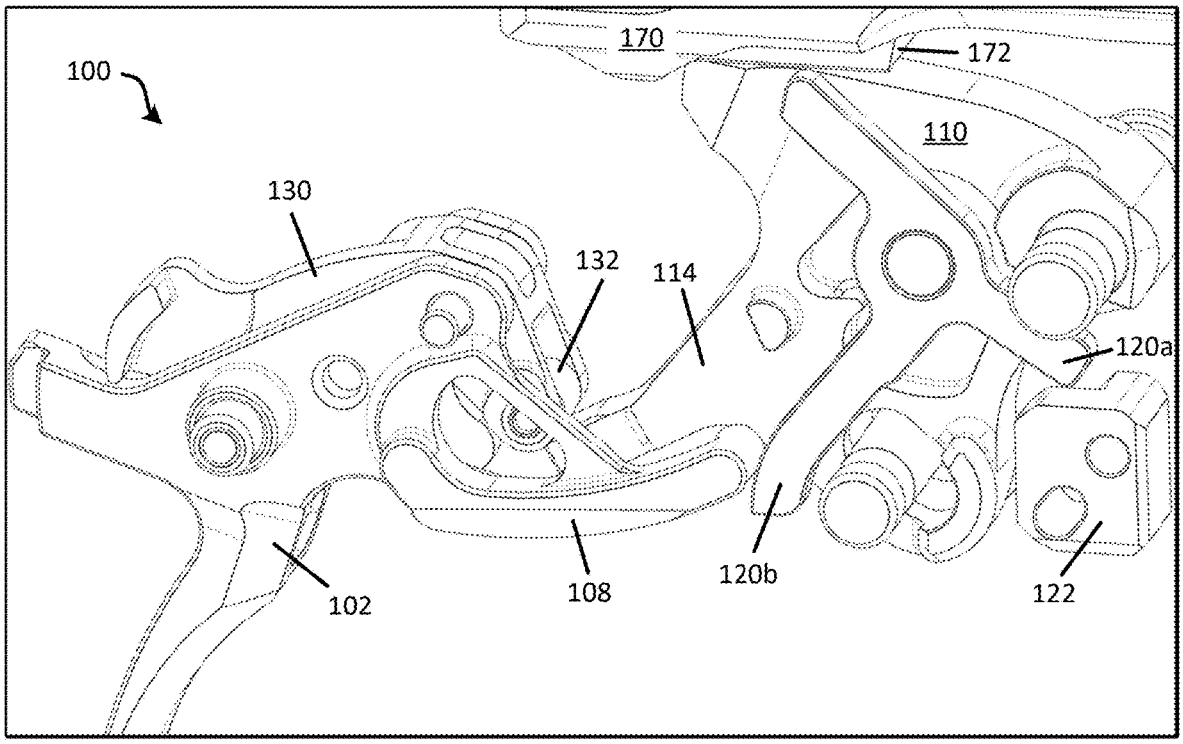

FIGS. 20A and 20B illustrate a side view and a perspective view, respectively, showing a sear 110, sear block 120, trigger 102, and sear link 130 with the trigger 102 pulled, in accordance with an embodiment of the present disclosure. In this example, the trigger 102 has been pulled so that the forward arm 108 contacted the rearward leg 120*b* of the sear block 120 and pivoted the sear block 120 to a non-blocking position. In the non-blocking position, the forward leg 120*a* is out of alignment with the block 122, permitting the sear 110 to rotate. In addition, the roller 132 on the sear link 130 made contact with the rear leg 114 of the sear 110 and pivoted the sear 110 out of engagement with the operational rod 170, releasing the operational rod 170 forward.

Figure 21A:
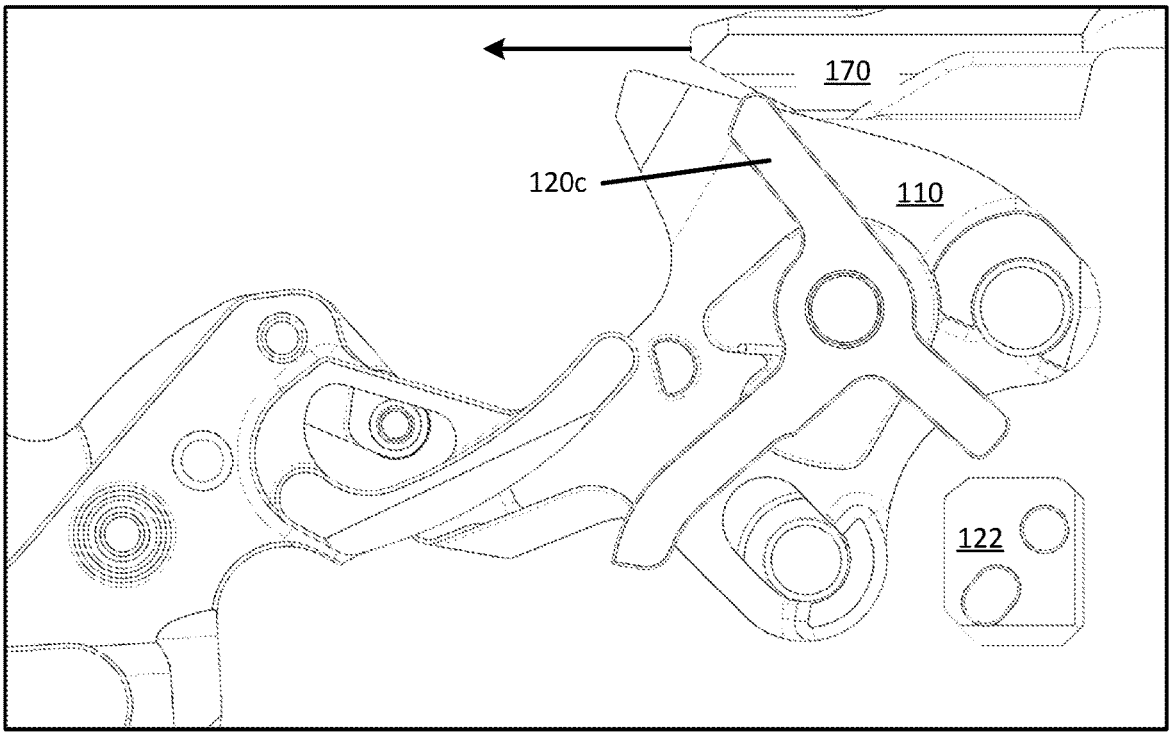
FIG. 21A illustrates a side view of an operational rod making initial contact with the sear during rearward movement, in accordance with an embodiment of the present disclosure

FIG. 21A illustrates a side view of an operational rod making initial contact with the sear block and the sear during a return stroke, in accordance with an embodiment of the present disclosure. At this stage of rearward movement, the operational rod 170 has contacted the upward leg 120*c* of the sear block 120 and rotated the sear block 120 to a non-blocking position. The operational rod 170 contacts the sear 110 and begins to pivot the sear 110 downward.

Figure 21B:
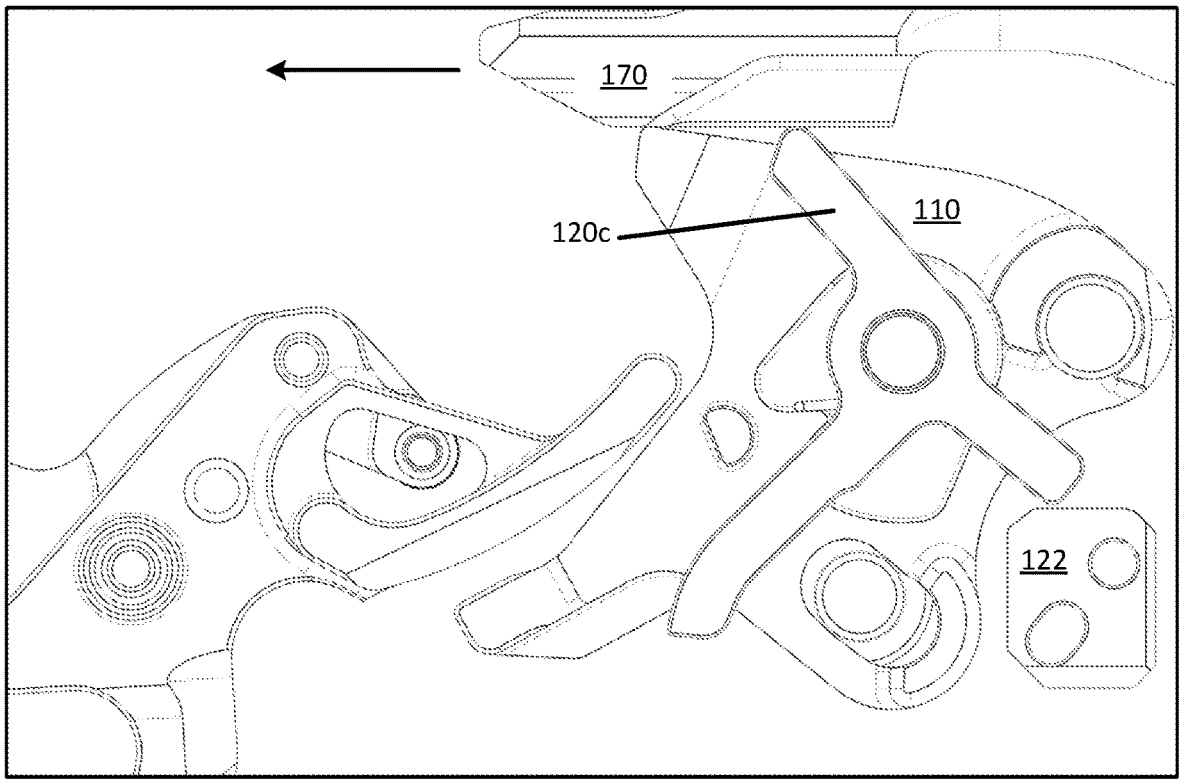
FIG. 21B illustrates a side view of the operational rod of FIG. 21A after further rearward movement, where the operational rod contacts the sear and sear block, deflecting the sear block to a non-blocking position and deflecting the sear downward to a clearance position with respect to the operational rod, in accordance with an embodiment of the present disclosure.

FIG. 21B illustrates a side view showing the operational rod 170 of FIG. 21A during a further stage of the return stroke. In this position, the operational rod 170 has moved further rearward to rotate the sear block 120 further to a non-blocking position and pivots the sear 110 downward to a clearance position. After the operational rod 170 moves rearward past the sear ledge 172, the sear 110 will pivot upward (clockwise) so that the sear 110 will engage the sear ledge 172 when the operational rod 170 returns forward, resulting in the operational rod 170 being held in the rearward or cocked position.

Figure 22:
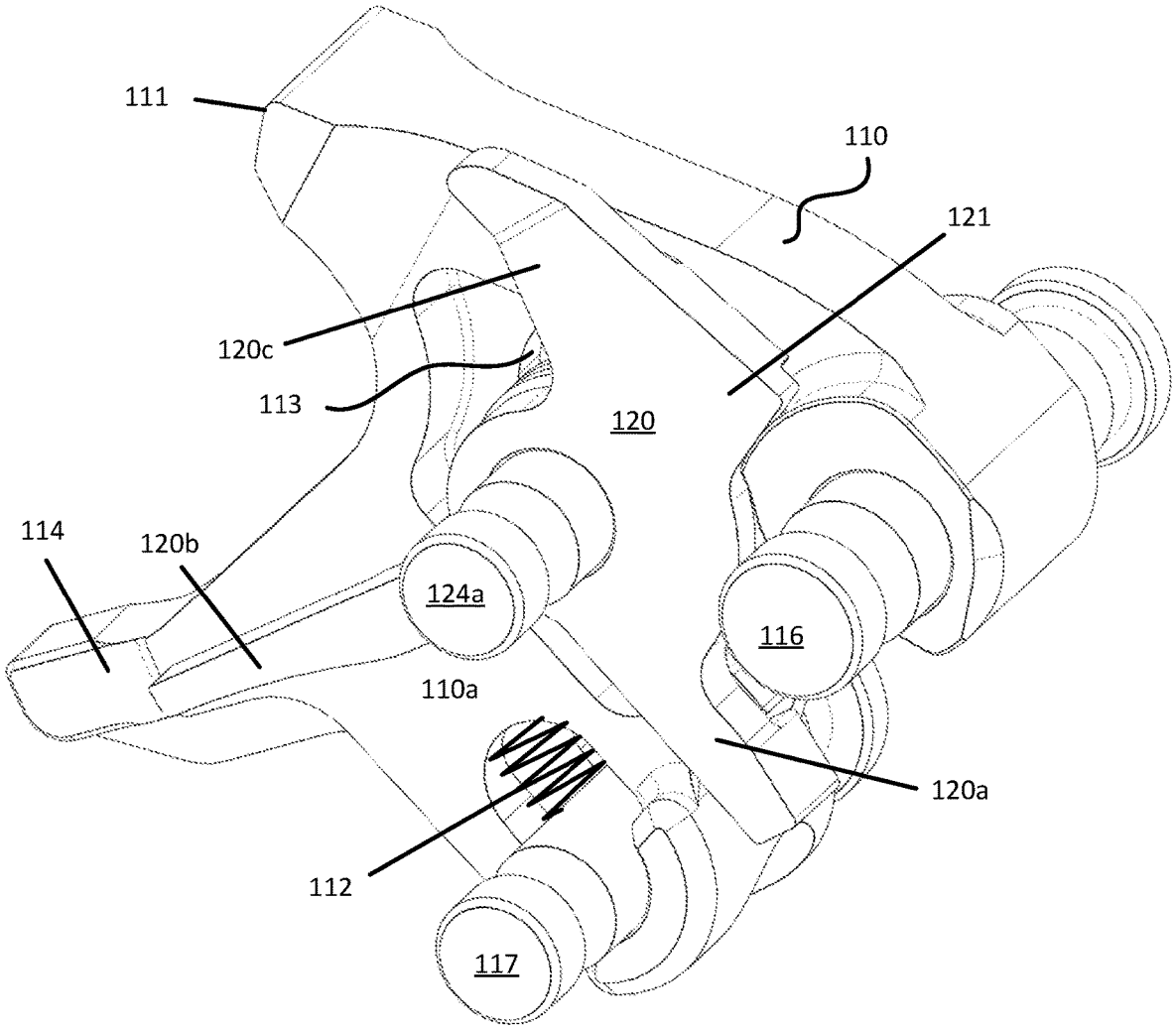
FIG. 22 illustrates a front perspective view of a sear and sear block, in accordance with another embodiment of the present disclosure.

FIG. 22 illustrates a front and side perspective view of a sear 110 and sear block 120, in accordance with another embodiment of the present disclosure. Similar to embodiments discussed above, the sear block 120 has a forward leg 120*a*, a rearward leg 120*b*, and an upward leg 120*c*. The legs 120*a*, 120*b*, 120*c* are spaced rotationally by about 1200 in this example, although other rotational distributions of the legs can be used. In contrast to embodiments discussed above, the sear block 120 can be pivoted about a pivot pin 124*a* that is fixed to the trigger housing (not shown) rather than a pivot pin that is attached to the sear 110. That is, the pivot pin 124*a* has a fixed position rather than moving with the sear 110. The sear block 120 can pivot about the pivot pin 124*a* between the blocking position (e.g., shown in FIG. 23) and non-blocking or clearance position (e.g., shown in FIG. 25). The sear block 120 is biased towards the blocking position in which the upward leg 120*c* extends upward into the path of the operational rod 170 (shown partially in FIG. 23). In such position, the upward leg 120*c* can arrest forward movement of the operational rod 170 from the cocked or rearward position, such as if the sear 110 disengages from the operational rod 170 due to an impulse. In this example, the sear hub concentric with the sear's pivot pin 116 acts as a stop to limit movement of the sear block 120 about the pivot pin 124*a*. For example, when the sear block 120 is pivoted maximally toward the blocking position (clockwise as shown in FIG. 22), a heel 121 of the upward leg 120*c* stops on the upper side of the sear hub concentric with the pivot pin 116. Contact between the heel 121 and the sear hub also provides a stable position of the upward leg 120*c* in the event the operational rod 170 moves forward and is arrested by the sear block 120.

The sear 110 can pivot about the sear pivot pin 116 an engaged position and a disengaged position with respect to the operational rod 170. The sear 110 is biased towards the engaged position by a sear spring 112 between a sear up-stop pin 117 and the sear body 110*a*. In the engaged position, a catch surface 111 on the sear 110 is in the path of the operational rod 170 and position to engage the sear ledge 172 to retain the operational rod 170 in the cocked position. The sear 110 has a rear leg 114 that is acted on by movement of the trigger 102 and sear link 130 (shown, e.g., in FIG. 23). The pivot pin 124*a* of the sear block 120 extends through a slot 113 in the sear 110. Thus, the sear 110 can pivot about sear pivot pin 116 independently of the sear block 120, which can pivot about the fixed pivot pin 124*a*.

Figure 23:
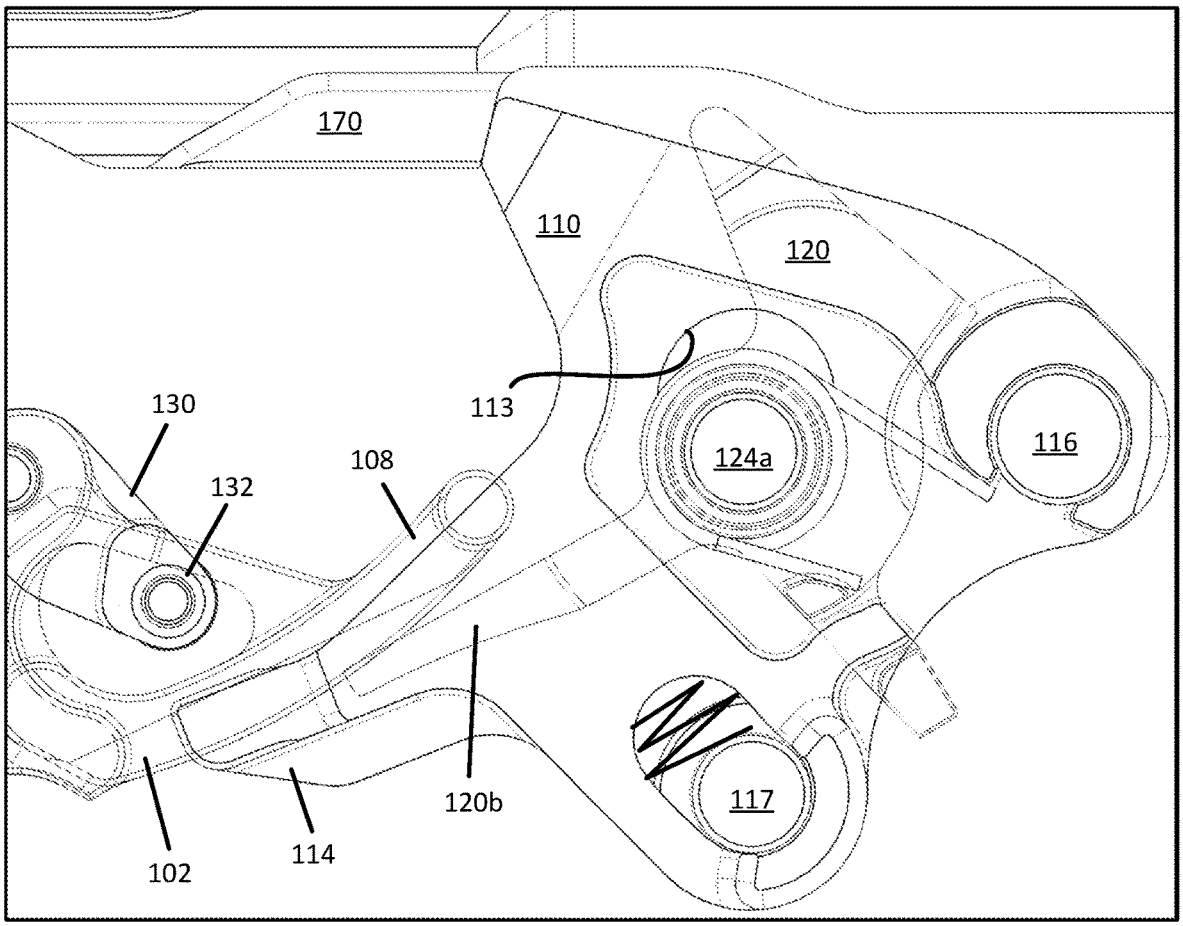
FIG. 23 illustrates a side view of the sear and sear block of FIG. 22 with the trigger at rest and the sear engaging the operational rod, in accordance with an embodiment of the present disclosure.

FIG. 23 illustrates a side view of the sear 110 and sear block 120 of FIG. 22 with the trigger 102 at rest and the sear 110 engaging the operational rod 170, in accordance with an embodiment of the present disclosure. When the trigger 102 is at rest, the forward arm 108 of the trigger 102 is spaced from the rearward leg 120*b* of the sear block 120 in some embodiments. This spacing can reduce or eliminate the chance that the trigger 102 will contact and move the sear block 120 to the non-blocking position in the event of a drop or other impulse. Accordingly, even if the sear 110 disengages from the operational rod 170 due, for example, to an impulse, the sear block 120 remains in the blocking position. When the trigger 102 is pulled from this position, the forward arm 108 of the trigger 102 will pivot down to engage the rearward leg 120*b* of the sear block 120 and rotate the sear block 120 to the non-blocking position. In turn, the roller 132 on the sear link 130 will pivot into contact with the rear leg 114 of the sear 110, pivoting the sear 110 out of engagement with the operational rod 170.

Figure 24:
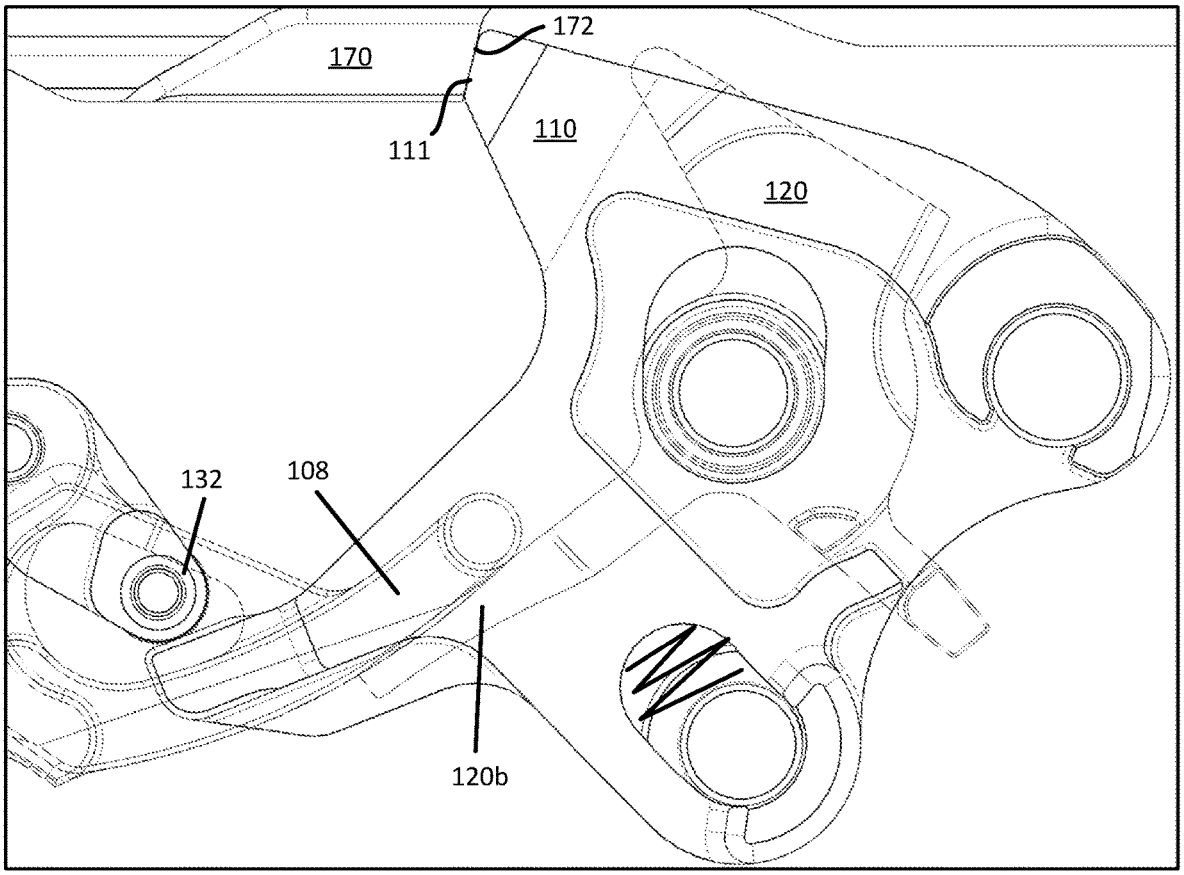
FIG. 24 illustrates a side view of the sear and sear block of FIG. 23 during the initial or take-up phase of a trigger pull, where the forward arm of the trigger makes contact with the sear block and the sear link roller contacts the sear, in accordance with an embodiment of the present disclosure.

FIG. 24 illustrates a side view of the sear 110 and sear block 120 of FIG. 23 during the initial or take-up phase of a trigger pull, in accordance with an embodiment of the present disclosure. In this position, the forward arm 108 of the trigger 102 has pivoted into contact with the sear block 120 and the roller 132 has pivoted into contact with the sear 110. The catch surface 111 on the sear 110 remains in contact with the sear ledge 172.

Figure 25:
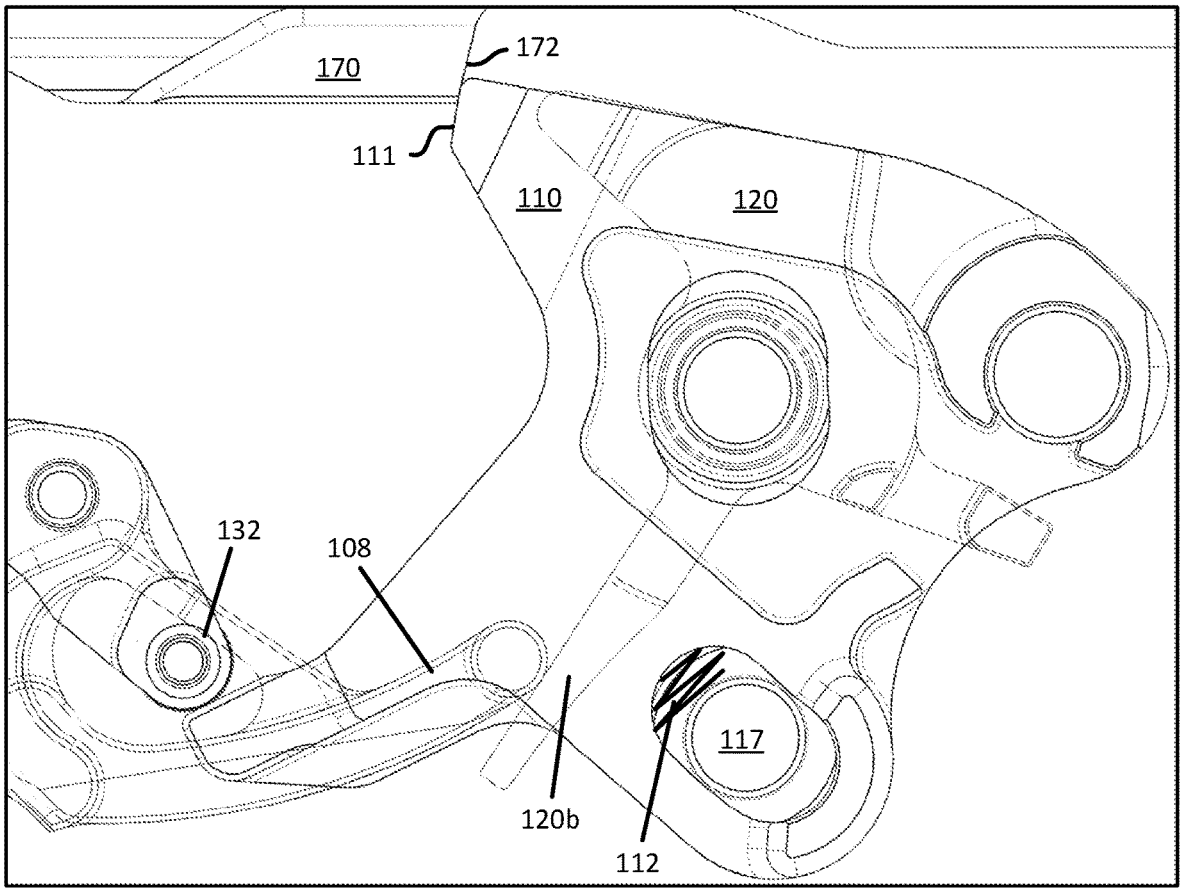
FIG. 25 illustrates a side view of the sear and sear block of FIG. 24 after further pulling the trigger, causing the sear block to pivot to a clearance position with respect to the operational rod and causing the sear to pivot counterclockwise towards disengagement from the operational rod, in accordance with an embodiment of the present disclosure.

FIG. 25 illustrates a side view of the sear 110 and sear block 120 of FIG. 24 after further pulling the trigger, causing the sear block 120 to pivot to a clearance position with respect to the operational rod 170 and causing the sear 110 to pivot counterclockwise towards disengagement from the sear ledge 172, in accordance with an embodiment of the present disclosure. The sear 110 is pivoted part way towards the disengaged position, as indicated by the central position of the sear up-stop pin 117 in the respective slot and by compression of the sear spring 112.

Figure 26:
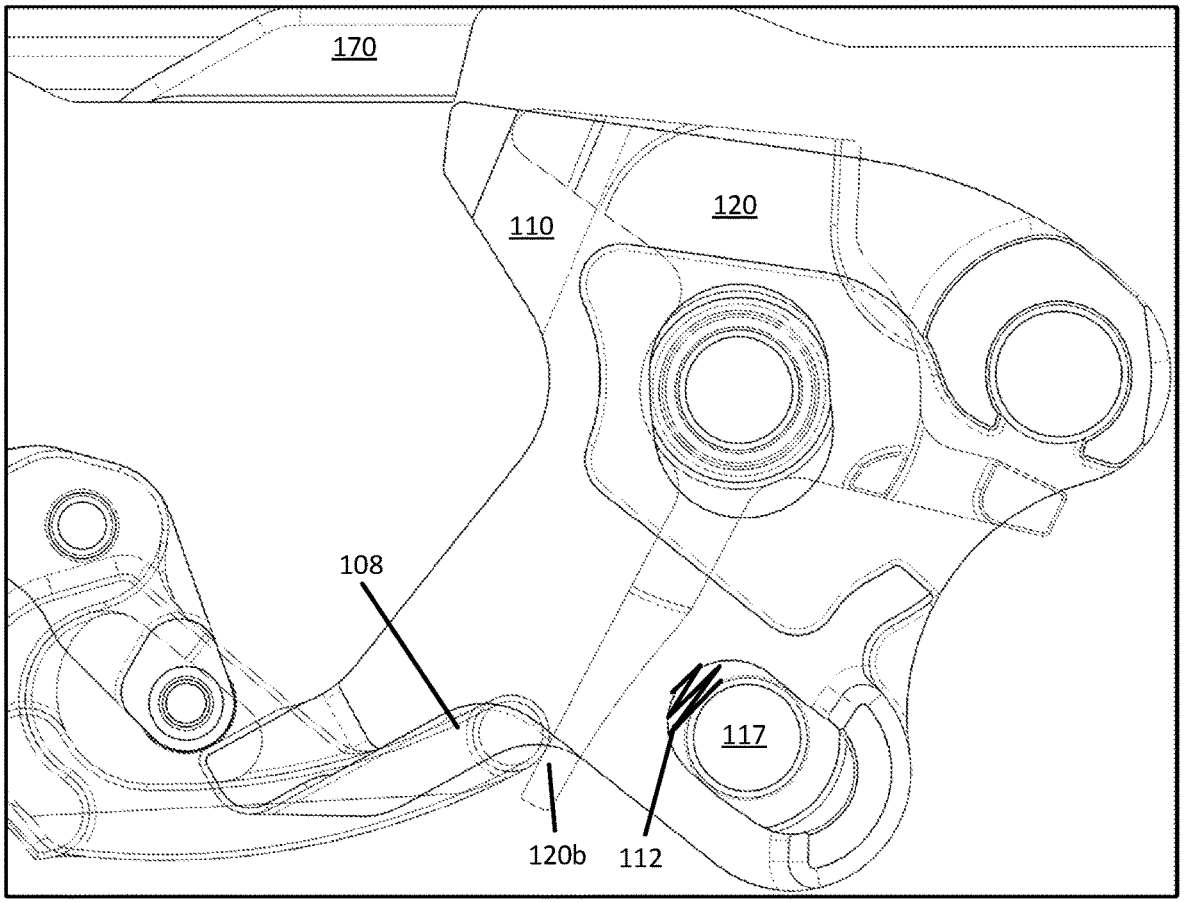
FIG. 26 illustrates a side view of the sear and sear block of FIG. 25 after the trigger has been pulled to break, where the sear is disengaged from the operational rod and permits the operational rod to move forward to fire, in accordance with an embodiment of the present disclosure.

FIG. 26 illustrates a side view of the sear 110 and sear block 120 of FIG. 25 after the trigger has been pulled to break, where the sear 110 disengages from the operational rod 170 and permits the operational rod 170 to move forward to fire, in accordance with an embodiment of the present disclosure. In this position, the sear spring 112 is further compressed due to the sear 110 pivoting further with respect to the sear bias pin 117. The sear block 120 remains in a clearance position due to maintained contact with the forward arm 108 of the trigger.

Figure 27:
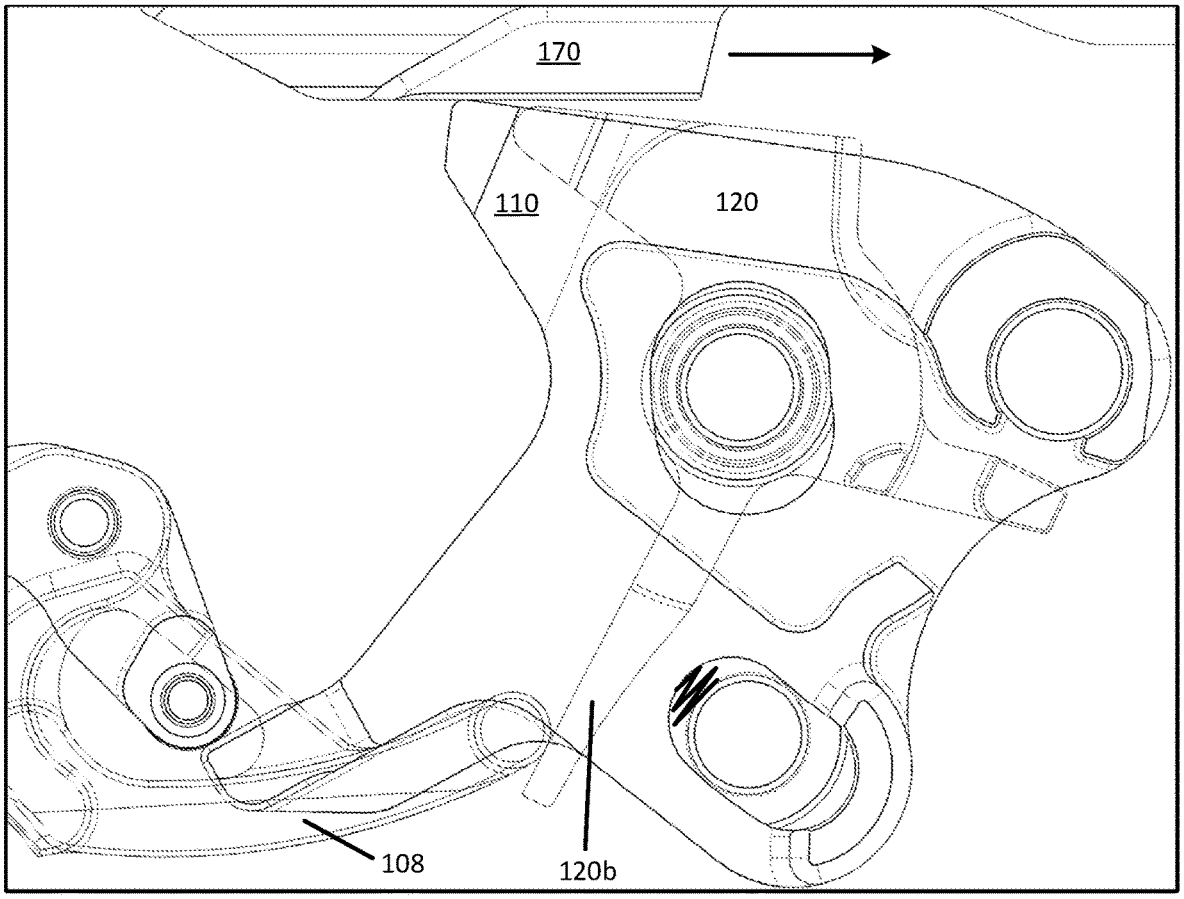
FIG. 27 illustrates a side view of the sear and sear block of FIG. 26 in a firing condition after the operational rod has started moving forward past the sear and sear block, in accordance with an embodiment of the present disclosure.

FIG. 27 illustrates a side view of the sear 110 and sear block 120 of FIG. 26 in a firing condition after the operational rod 170 has started moving forward past the sear 110 and sear block 120, in accordance with an embodiment of the present disclosure.

Further Example Embodiments

The following examples pertain to further embodiments, from which numerous permutations and configurations will be apparent.

Example 1 is a trigger assembly for a firearm having an operational rod configured to reciprocate longitudinally along a bore axis of the machine gun. The trigger assembly includes a trigger rotatable between a resting position and a pulled position. A disconnector can pivot between a first position in which a part of the disconnector is in a path of the operational rod, and a second position in which the part of the disconnector is out of the path of the operational rod. A sear can pivot between an engaged position and a disengaged position. The sear is biased toward the engaged position and when in the engaged position, a part of the sear is positioned to engage the operational rod. A sear link is pivotably connected to the trigger, wherein pulling the trigger moves the sear link into contact with the sear to pivot the sear towards the disengaged position. The sear link is spaced from the sear when the trigger is in the resting position. A selector is operable between a safe position, a fully automatic fire position, and a semiautomatic fire position.

Example 2 includes the trigger assembly of Example 1 and further includes a trigger blocking component movable between a trigger blocking position and a trigger non-blocking position in response to operating the selector, wherein when the selector is in the safe position the trigger block component is in the trigger blocking position.

Example 3 includes the trigger assembly of Example 1, where the selector is operable to pivot the disconnector.

Example 4 includes the trigger assembly of any of the foregoing examples, where when the selector is in the fully automatic fire position, the disconnector is in the second position in which the part of the disconnector is out of the path of the operational rod.

Example 5 includes the trigger assembly of any of Examples 1-4, where when the selector is in the semiautomatic fire position, the disconnector is biased toward the first position in which the part of the disconnector is in the path of the operational rod.

Example 6 includes the trigger assembly of Example 5, where moving the selector from the fully automatic fire position to the semiautomatic fire position pivots the disconnector from the second position to the first position.

Example 7 includes the trigger assembly of Example 6, where when the selector is in the semiautomatic fire position, the disconnector causes the sear link to disconnect from sear when the trigger is moved to the pulled position.

Example 8 includes the trigger assembly of any one of Examples 1-7, where the trigger and the sear link move together as one when the trigger moves from the resting position to the pulled position.

Example 9 includes the trigger assembly of Example 8, where the disconnector reduces a range of pivot movement of the sear link when the selector is in the fully automatic fire position, thereby maintaining contact between the sear link and the sear while the trigger is in the pulled position.

Example 10 includes the trigger assembly of any of Examples 1-9, where the sear link includes a roller positioned to engage the sear.

Example 11 includes the trigger assembly of any of Examples 1-10 and further includes a disconnector catch pivotable between a first position and a second position. When the selector is in the semiautomatic fire position, the disconnector catch engages the disconnector, thereby preventing the sear link from reconnecting with the sear when the trigger is in the pulled position and the operational rod is on top of the sear and the disconnector during the rearward motion of the operational rod.

Example 12 includes the trigger assembly of any one of Examples 1-11, where the operational rod can be moved from a forward position to a cocked position when the selector is in the safe position.

Example 13 includes the trigger assembly of Example 12 and further comprises a sear block pivotably mounted to the sear, where the sear block is pivotable between a blocking position and a non-blocking position. When in the blocking position, the sear block prevents the sear from moving to the disengaged position.

Example 14 includes the trigger assembly of Example 12 and further comprises a trigger housing containing components of the trigger assembly including the sear block, wherein the sear block is pivotably mounted to the trigger housing between a blocking position and a non-blocking position. When in the blocking position, the sear block prevents the sear from moving to the disengaged position.

Example 15 includes the trigger assembly of Example 13 or 14, where the trigger includes a trigger body including a trigger axis of rotation, a trigger blade extending rearwardly from the trigger body, and a forward arm extending forward from the trigger body, wherein when moving the trigger from the resting position to the pulled position the forward arm pivots the sear block to the non-blocking position.

Example 16 includes the trigger assembly of Example 15, where a gap exists between the forward arm of the trigger and the sear block when the trigger is in the resting position.

Example 17 includes the trigger assembly of Example 16 and further comprises a sear block pivotable between a blocking position and a non-blocking position. When in the blocking position, a part of the sear block is in a path of the operational rod. When in the non-blocking position, the part of the sear block is out of the path of the operational rod. Pulling the trigger to the pulled position pivots the sear block to the non-blocking position and pivots the sear to the disengaged position.

Example 18 includes the trigger assembly of any of Examples 1-17, where the trigger includes a trigger body having a trigger axis of rotation and a forward arm extending forward from the trigger body. Pulling the trigger from the resting position to the pulled position causes the forward arm to contact the sear block and pivot the sear block to the non-blocking position.

Example 19 includes the trigger assembly of any of Examples 1-18, where the selector is operably connected to a gear assembly such that rotating the selector rotates gears of the gear assembly.

Example 20 includes the trigger assembly of Example 19, where the gear assembly comprises a first gear concentric with an axis of rotation of the selector, a second gear operably connected to the first gear, and a third gear operably connected to the second gear. The gears are arranged so that rotating the first gear in a first rotational direction rotates the third gear in the first rotational direction and rotates the second gear in an opposite second rotational direction.

Example 21 includes the trigger assembly of Example 20 and further comprises a trigger block fixedly attached to the second gear, where the trigger block rotates with the second gear.

Example 22 includes the trigger assembly of Example 20 or 21 and further comprises a cam attached to the third gear, the cam having a portion of greater diameter and a portion of lesser diameter. The cam rotates with the third gear to change a position of the disconnector.

Example 23 is a firearm including the trigger assembly of any of the foregoing Examples.

Example 24 is the firearm of Example 23, where the firearm is a machine gun configured to fire from an open-bolt condition.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A trigger assembly for a firearm having an operational rod configured to reciprocate longitudinally along a bore axis of the firearm, the trigger assembly comprising:

a trigger rotatable between a resting position and a pulled position;

a disconnector pivotable between a first position in which a part of the disconnector is in a path of the operational rod and a second position in which the part of the disconnector is out of the path of the operational rod;

a sear pivotable between an engaged position and a disengaged position, the sear biased toward the engaged position, wherein in the engaged position a part of the sear is positioned to engage the operational rod;

a sear link pivotably connected to the trigger, wherein pulling the trigger moves the sear link into contact with the sear to pivot the sear towards the disengaged position, and wherein the sear link is spaced from the sear when the trigger is in the resting position; and a selector operable between a safe position, a fully automatic fire position, and a semiautomatic fire position.

2. The trigger assembly of claim 1, further comprising a trigger blocking component movable between a trigger blocking position and a trigger non-blocking position in response to operating the selector, wherein when the selector is in the safe position the trigger blocking component is in the trigger blocking position.

3. The trigger assembly of claim 1, wherein the selector is operable to pivot the disconnector.

4. The trigger assembly of claim 3, wherein when the selector is in the fully automatic fire position, the disconnector is in the second position in which the part of the disconnector is out of the path of the operational rod.

5. The trigger assembly of claim 4, wherein when the selector is in the semiautomatic fire position, the disconnector is biased toward the first position in which the part of the disconnector is in the path of the operational rod.

6. The trigger assembly of claim 5, wherein moving the selector from the fully automatic fire position to the semiautomatic fire position pivots the disconnector from the second position to the first position.

7. The trigger assembly of claim 6, wherein when the selector is in the semiautomatic fire position, the disconnector causes the sear link to disconnect from sear when the trigger is moved to the pulled position.

8. The trigger assembly of claim 1, wherein the trigger and the sear link move together as one when the trigger moves from the resting position to the pulled position.

9. The trigger assembly of claim 8, wherein the disconnector reduces a range of pivot movement of the sear link when the selector is in the fully automatic fire position, thereby maintaining contact between the sear link and the sear while the trigger is in the pulled position.

10. The trigger assembly of claim 9, wherein the sear link includes a roller positioned to engage the sear.

11. The trigger assembly of claim 9, further comprising a disconnector catch pivotable between a first position and a second position, wherein when the selector is in the semiautomatic fire position the disconnector catch engages the disconnector, thereby preventing the sear link from reconnecting with the sear when the trigger is in the pulled position, and when the operational rod is on top of the sear and the disconnector during its rearward motion.

12. The trigger assembly of claim 1, wherein the operational rod can be moved from a forward position to a cocked position when the selector is in the safe position.

13. The trigger assembly of claim 12, further comprising a sear block pivotably mounted to the sear, the sear block pivotable between a blocking position and a non-blocking position, wherein in the blocking position the sear block prevents the sear from moving to the disengaged position.

14. The trigger assembly of claim 13, wherein the trigger includes a trigger body including a trigger axis of rotation, a trigger blade extending rearwardly from the trigger body, and a forward arm extending forward from the trigger body, wherein when moving the trigger from the resting position to the pulled position causes the forward arm to contact the sear block and pivot the sear block to the non-blocking position.

15. The trigger assembly of claim 14, wherein a gap exists between the forward arm of the trigger and the sear block when the trigger is in the resting position.

16. The trigger assembly of claim 12, further comprising:

a trigger housing containing components of the trigger assembly; and a sear block pivotably mounted to the trigger housing, the sear block pivotable between a blocking position and a non-blocking position, wherein in the blocking position the sear block prevents the sear from moving to the disengaged position.

17. The trigger assembly of claim 16, wherein the trigger includes a trigger body including a trigger axis of rotation, a trigger blade extending rearwardly from the trigger body, and a forward arm extending forward from the trigger body, wherein when moving the trigger from the resting position to the pulled position causes the forward arm to contact the sear block and pivot the sear block to the non-blocking position.

18. The trigger assembly of claim 17, wherein a gap exists between the forward arm of the trigger and the sear block when the trigger is in the resting position.

19. The trigger assembly of claim 1, further comprising a sear block pivotable between a blocking position and a non-blocking position, wherein:

in the blocking position a part of the sear block is in a path of the operational rod;

in the non-blocking position, the part of the sear block is out of the path of the operational rod; and pulling the trigger to the pulled position pivots the sear block to the non-blocking position and pivots the sear to the disengaged position.

20. The trigger assembly of claim 1, wherein the selector is operably connected to a gear assembly such that rotating the selector rotates gears of the gear assembly.

21. The trigger assembly of claim 20, wherein the gear assembly comprises a first gear concentric with an axis of rotation of the selector, a second gear operably connected to the first gear, and a third gear operably connected to the second gear such that rotating the first gear in a first rotational direction rotates the third gear in the first rotational direction and rotates the second gear in an opposite second rotational direction.

22. The trigger assembly of claim 21, further comprising a trigger block attached to the second gear, wherein the trigger block rotates with the second gear.

23. The trigger assembly of claim 21, further comprising a cam attached to the third gear, the cam having a portion of greater diameter and a portion of lesser diameter, wherein the cam rotates with the third gear to change a position of the disconnector.

24. A machine gun comprising the trigger assembly of claim 1.

* * * * *